US010190246B2

(12) United States Patent
Neely et al.

(10) Patent No.: US 10,190,246 B2
(45) Date of Patent: Jan. 29, 2019

(54) TUFTING MACHINE DRIVE SYSTEM

(71) Applicant: CARD-MONROE CORP., Chattanooga, TN (US)

(72) Inventors: Marshall Allen Neely, Soddy Daisy, TN (US); Ricky E. Mathews, Sale Creek, TN (US); Daryl L. Gibson, Dayton, TN (US)

(73) Assignee: Card-Monroe Corp., Chattanooga, TN (US)

( * ) Notice: Subject to any disclaimer, the term of this patent is extended or adjusted under 35 U.S.C. 154(b) by 0 days.

(21) Appl. No.: 16/022,233

(22) Filed: Jun. 28, 2018

(65) Prior Publication Data

US 2018/0305849 A1 Oct. 25, 2018

Related U.S. Application Data

(63) Continuation of application No. 14/445,231, filed on Jul. 29, 2014, now Pat. No. 10,011,932, which is a (Continued)

(51) Int. Cl.
*D05C 15/00* (2006.01)
*D05C 15/12* (2006.01)
(Continued)

(52) U.S. Cl.
CPC ..... *D05C 15/12* (2013.01); *D05C 15/10* (2013.01); *D05C 15/20* (2013.01); *D05C 15/30* (2013.01)

(58) Field of Classification Search
CPC ... D05C 5/04; D05C 5/08; D05C 5/10; D05C 5/12; D05C 5/14; D05C 5/20; D05C 5/30
See application file for complete search history.

(56) References Cited

U.S. PATENT DOCUMENTS 3,109,395 A 11/1963 Batty et al.
3,301,205 A 1/1967 Card
(Continued)

FOREIGN PATENT DOCUMENTS

DE 3027992 A1 2/1981
GB 2055193 A 3/1981
WO WO 01/59195 A2 8/2001

OTHER PUBLICATIONS

International Search Report and Written Opinion for related PCT Application No. PCT/US2014/039815, dated Sep. 23, 2014.
(Continued)

*Primary Examiner* — Nathan Durham
(74) *Attorney, Agent, or Firm* — Womble Bond Dickinson (US) LLP

(57) ABSTRACT

A tufting machine has a needle bar for carrying a plurality of needles for reciprocating into and out of a base material. A sliding needle bar shift mechanism may shift the needle bar laterally according to a pattern. The needle bar is mounted for reciprocation and for lateral movement relative to the direction of reciprocation by a drive system including a first directional drive component having a foot secured to a respective push rod of the tufting machine and a second directional drive component connected to the shift mechanism. The first and second drive components will connect to the needle bar through linear bearings or bushings so that the motion of the needle bar in multiple different directions is controlled while permitting greater machine operating and needle bar shifting speeds.

14 Claims, 15 Drawing Sheets

Related U.S. Application Data continuation-in-part of application No. 14/289,069, filed on May 28, 2014, now Pat. No. 9,260,810.

(60) Provisional application No. 61/828,412, filed on May 29, 2013.

(51) Int. Cl.

| | |
|---|---|
| ***D05C 15/20*** | (2006.01) |
| ***D05C 15/30*** | (2006.01) |
| ***D05C 15/10*** | (2006.01) |

(56) References Cited

U.S. PATENT DOCUMENTS

| | | | | |
|---|---|---|---|---|
| 3,943,865 | A | 3/1976 | Short et al. | |
| 3,964,407 | A | 6/1976 | Ingram et al. | |
| 3,964,408 | A | 6/1976 | Smith | |
| 3,972,295 | A | 8/1976 | Smith | |
| 3,982,491 | A | 9/1976 | Herzer et al. | |
| 4,010,700 | A | 3/1977 | Webb | |
| 4,119,049 | A | 10/1978 | Puckett | |
| 4,173,192 | A | 11/1979 | Schmidt et al. | |
| 4,224,884 | A | 9/1980 | Shortte | |
| 4,261,498 | A | 4/1981 | Short | |
| 4,282,818 | A | 8/1981 | Ingram | |
| 4,366,761 | A * | 1/1983 | Card | D05C 15/30 112/80.23 |
| 4,398,479 | A | 8/1983 | Czelusniak, Jr. | |
| 4,399,758 | A | 8/1983 | Bagnall | |
| 4,440,102 | A | 4/1984 | Card et al. | |
| 4,445,447 | A | 5/1984 | Bardsley | |
| 4,465,001 | A | 8/1984 | Ingram | |
| 4,483,260 | A | 11/1984 | Gallant | |
| 4,501,212 | A | 2/1985 | Slattery | |
| 4,515,096 | A | 5/1985 | Ingram | |
| 4,519,326 | A | 5/1985 | Green et al. | |
| 4,586,445 | A | 5/1986 | Card et al. | |
| 4,630,558 | A | 12/1986 | Card et al. | |
| 4,653,293 | A | 3/1987 | Porat | |
| 4,653,413 | A | 3/1987 | Bagnall | |
| 4,662,291 | A | 5/1987 | Bardsley | |
| 4,665,845 | A | 5/1987 | Card et al. | |
| 4,759,199 | A | 7/1988 | Prichard | |
| 4,815,402 | A | 3/1989 | Price | |
| 4,829,917 | A | 5/1989 | Morgante et al. | |
| 5,058,518 | A | 10/1991 | Card et al. | |
| 5,080,028 | A | 1/1992 | Ingram | |
| 5,205,229 | A | 4/1993 | Job | |
| 5,205,233 | A | 4/1993 | Ingram | |
| 5,224,434 | A | 7/1993 | Card et al. | |
| 5,295,450 | A | 3/1994 | Neely | |
| 5,383,415 | A | 1/1995 | Padgett, III | |
| 5,392,723 | A | 2/1995 | Kaju | |
| 5,427,039 | A | 6/1995 | Bagnell | |
| 5,513,586 | A | 5/1996 | Neely et al. | |
| 5,526,760 | A | 6/1996 | Ok | |
| 5,549,064 | A | 8/1996 | Padgett, III | |
| 5,555,826 | A | 9/1996 | Shatterfield | |
| 5,560,307 | A * | 10/1996 | Padgett, III | D05C 15/14 112/410 |
| 5,562,056 | A * | 10/1996 | Christman, Jr. | D05C 15/14 112/80.33 |
| 5,588,383 | A | 12/1996 | Davis et al. | |
| 5,645,001 | A | 7/1997 | Green et al. | |
| 5,706,745 | A | 1/1998 | Neely et al. | |
| 5,743,200 | A | 4/1998 | Miller et al. | |
| 5,794,551 | A | 8/1998 | Morrison et al. | |
| 5,806,446 | A | 9/1998 | Morrison et al. | |
| 5,809,917 | A | 9/1998 | McGowan et al. | |
| 5,979,344 | A | 11/1999 | Christman, Jr. | |
| 6,263,811 | B1 | 7/2001 | Crossley | |
| 6,283,052 | B1 | 9/2001 | Pratt | |
| 6,293,210 | B1 | 9/2001 | Freeman et al. | |
| 6,293,211 | B1 | 9/2001 | Samilo | |
| 6,318,730 | B1 | 11/2001 | Neely | |
| 6,776,109 | B2 | 8/2004 | Segars et al. | |
| 6,827,030 | B2 | 12/2004 | Hicks | |
| 7,814,850 | B2 | 10/2010 | Bearden | |
| 7,836,836 | B2 | 11/2010 | Brewer | |
| 8,256,364 | B2 | 9/2012 | Vaughan et al. | |
| 8,671,858 | B2 | 3/2014 | Morgante et al. | |
| 9,260,810 | B2 * | 2/2016 | Neely | D05C 15/10 |
| 10,011,932 | B2 | 7/2018 | Neely et al. | |
| 2006/0137581 | A1 | 6/2006 | Mile et al. | |
| 2010/0224113 | A1 | 9/2010 | Morgante et al. | |
| 2013/0340660 | A1 | 12/2013 | Vaughan et al. | |

OTHER PUBLICATIONS

Extended European Search Report for related Application No. 14803701.3, dated Dec. 20, 2016.

Linear Rolling Bearings; Precision Machine Design, ME EN 7960, pp. 1-23; available at http://www.mech.utah.edu/~me7960/lectures/Topic8-LinearRollingBearings.pdf; Jun. 2010.

LM Guide, THK Global, pp. 1-5; available at http://www.thk.com/?q=eng/node/231; Mar. 2011.

* cited by examiner

TUFTING MACHINE DRIVE SYSTEM

CROSS REFERENCE TO RELATED APPLICATIONS

The present patent application is a Continuation of co-pending U.S. patent application Ser. No. 14/445,231, filed Jul. 29, 2014, which is a Continuation-in-Part of U.S. patent application Ser. No. 14/289,069, filed May 28, 2014, now U.S. Pat. No. 9,260,810 which is a formalization of previously filed, U.S. Provisional Patent Application Ser. No. 61/828,412, filed May 29, 2013 by the inventors named in the present application. This patent application claims the benefit of the filing date of this cited Provisional patent application according to the statutes and rules governing provisional patent applications, particularly 35 U.S.C. § 119(a)(i) and 37 C.F.R. § 1.78(a)(4) and (a)(5).

FIELD OF THE INVENTION

The present invention generally relates to machine drive systems in which operative elements are designed to be driven or reciprocated in multiple, different directions. In particular, the present invention is directed to a drive system for tufting machines for use in guiding and controlling movement of operative elements thereof, such as controlling the motion of one or more needle bars of a tufting machine in multiple directions.

BACKGROUND OF THE INVENTION

Conventional tufting machines used for the formation of tufted articles such as carpets can include one or more needle bars that carry a plurality of needles arranged in spaced series therealong. Each needle bar typically is driven in a vertically reciprocating manner by a plurality of push rods, which are linked to and thus driven by rotation of a main driveshaft of the tufting machine, so as to reciprocate the needles into and out of a breaking material. The needles carry a series of yarns into the backing material and are engaged by a series of loopers or hooks to form tufts of yarns in the backing material. The needle bar or needle bars further can be shifted laterally with respect to the backing material moving therebelow to provide desired patterning effects and reduce the effects of yarn streaking.

The mounting of a needle bar or needle bars for reciprocation while permitting transverse or lateral shifting movement typically has been accomplished by connection of the needle bar(s) to the push rods by brackets or feet through which the needle bar(s) are slidably received. As a result, as the push rods reciprocate the needle bar(s) vertically, the needle bar(s) further can be shifted or slid laterally though the support feet, which have included ball bearings or bushings in order to facilitate the sliding movement of the needle bar. For example, U.S. Pat. Nos. 4,662,291 and 4,501,212 illustrate prior sliding needle bar drive systems.

The use of such ball bearings or bushings, however, often is limited in terms of the loads they can support, especially at higher machine operating speeds, and further can be subject to increased or more rapid wearing at such increased operating speeds. Advances in production capacity of tufting machines are highly desirable and thus are in demand by the producers or manufacturers of tufted articles such as carpets, as the faster and more efficiently the tufting machines can be run, the more savings in terms of labor and other operational costs can be realized. Currently, conventional tufting machines can be run at upwards of approximately 750 to over 1,300 rpm, and in some cases, in excess of approximately 2,000 rpm. However, at such higher reciprocation/operational speeds, it becomes difficult to accurately control shifting of the needle bars, and the drive systems further can be subjected to increased vibrational forces as well as increased heat and wear due to the effects of the friction between the hardened shafts and ball bearings/bushings traditionally used for guiding the shift rods and push rods of such needle bar drive systems.

Accordingly, it can be seen that a need exists for an improved tufting machine drive system that enables multi-directional movement of operative elements of a tufting machine, such as the reciprocation and lateral shifting or sliding movement of a needle bar of a tufting machine, which addresses the foregoing and other related and unrelated problems in the art.

SUMMARY OF THE INVENTION

Briefly described, the present invention generally relates to a drive system for controlling and facilitating the multi-directional movement of various driven operative elements of a tufting machine. For example, the present invention can be used for the driving of one or more needle bars of a tufting machine wherein each needle bar can be vertically reciprocated while additionally being capable of lateral shifting or sliding movement. The drive system can provide enhanced rigidity and dimensional stability to the needle bar(s) during reciprocating and shifting movements to enable tighter control and improved precision of multi-directional movements of the needle bar. As a result, the tufting machine can be run at increased operational speeds so as to provide increased production capacity, while at the same time reducing incidence of excessive wear of the drive system components at such increased operating speeds. The principles of the present invention further can be applied to the driving of other operative elements of the tufting machine, in addition to the driving of one or more shifting or slidable needle bars.

The drive system can be mounted on a tufting machine having a frame defining a tufting area or zone through which a backing material is fed, and at least one needle bar. A tufting machine main driveshaft mounted will be linked to the needle bar in a driving relationship therewith. A series of needles will be mounted in spaced series along the length of the needle bar, or needle bars if more than one is used, with the needles typically being arranged at a desired gauge or preset spacing, and with a series of yarns being fed to each of the needles as the needles are reciprocated into and out of the backing material, a series of gauge elements such as loop pile loopers, cut pile hooks, LCL loopers, cut loop clips, knives, various other gauge parts and/or combinations thereof, will engage the needles to form the tufts of yarns in the backing material.

In one example embodiment, in a tufting machine having at least one shifting needle bar, the drive system can comprise a first, vertically reciprocating directional drive component or section for driving the needle bar in a first direction, (e.g. along a vertically reciprocating stroke or motion) and a second moving the needle bar in a second direction, (e.g. along a transverse motion lateral or sliding motion) directional drive component or section for control different movements of the needle bar in multiple different directions. The first directional drive component generally will include a series of needle bar support brackets or feet which receive a series of push rods and which are slidably connected to and support the needle bar. The push rods further generally will be connected to and driven off of the main driveshaft of the tufting machine to drive the needle bar along a desired stroke wherein the needles are reciprocated into and out of the backing.

Each of the support brackets can include an elongated guide channel through which the needle bar, or a guide member mounted to the needle bar, can be received. In one example embodiment, each support bracket can include an elongated body having an approximately centrally located upper portion that receives a proximal end of the push rod in a clamped engagement therewith, and a lower portion having a linear motion bearing bracket mounted to the bottom or lower surface of the upper body portion, in which a linear bearing guide or raceway mechanism, including an elongated guide track, is slidably received. The linear motion bearing bracket generally will include at least one linear motion bearing assembly, which can have one or more sets/series of linear bearings, typically ball bearings although roller bearings or other linear bearings also can be used, located along one or both sides of the linear motion bearing guide for guiding and controlling the linear sliding motion of the guide track therethrough. The guide track can be attached at one or more locations to the needle bar so as to securely couple the needle bar to the push rods while facilitating lateral movement of the needle bar with respect to the push rods.

In other embodiments, such as where the tufting machine includes multiple shiftable needle bars, a series of spaced guide tracks, each mounted along one of the needle bars, can engage corresponding linear motion bearing guides mounted to each needle support bracket or foot. The guide tracks can be mounted to their needle bars by support plates. The support plates can extend along the needle bars, and can include channels, recesses, or slots in which the guide tracks are received. These channels or slots can be arranged along upper and/or side surfaces of the support plates depending on the size or configuration of the needle bars.

In a further embodiment, the upper portions of the support brackets can be mounted to the clamp bolts or similar fasteners that can be located at or adjacent the corners of the support brackets, and shoulder bolts adapted to limit vertical travel or movement between the upper and lower portions of the support brackets, including upon removal of the clamp bolts. Shims can be received within gaps defined between the upper and lower portions of the body of each support bracket. In one embodiment, the shims can include stackable bodies, which can be visually detected from a front or side portion of the support brackets to provide a visual indication as to the size, type and/or number of shims used, as well as whether the installed shims are straight. The push rods also can be provided with replaceable end portions that can be used, in addition to or in place of the shims, to facilitate adjustment of the length of the push rods, and thus adjust the stroke or depth of penetration of the needles into and out of the backing, without requiring replacement of the entire push rods.

The second directional drive component of the drive system of the present invention will link the needle bar to a shifting mechanism for controlling the lateral shifting or stepping of the one or more needle bars across the tufting zone and transverse to the direction of movement of the backing material therethrough to form desired tufting patterns. The second directional drive component of the drive system can include a single drive rod, or alternatively, a pair of drive rods or bars spaced apart a distance sufficient to enable passage of the push rods and/or at least a portion of the connecting arms that connect the needle bars to the drive rod(s) of the second directional drive component therebetween. Each of the connecting arms can include a base that mounts to the needle bar, and an upper portion, which can include guide tracks or rails mounted thereto, or which can be configured with guide channels or grooves therealong. The guide tracks each are received within guides or shift control brackets having linear motion bearing assemblies mounted and extending therealong. The engagement and movement of the tracks along the linear motion bearing assemblies of the shift control brackets guides and controls the vertical movement of the connecting arms as the needle bar is reciprocated by operation of the push rods, to resist torsion or twisting and provide a substantially straight-line movement thereof. Additionally, the drive rod, or spaced drive rods if used, further can have a series of linear bearing motion guides that engage one or more guide tracks mounted to the frame of the tufting machine to provide additional support and rigidity to the needle bar, during its multi-directional movements to promote greater dimensional stability of the tufted fabrics being formed.

Various features, objects and advantages of the present invention will become apparent to those skilled in the art upon a review of the following detailed description of the invention, when taken in conjunction with the accompanying drawings.

Figure 1:
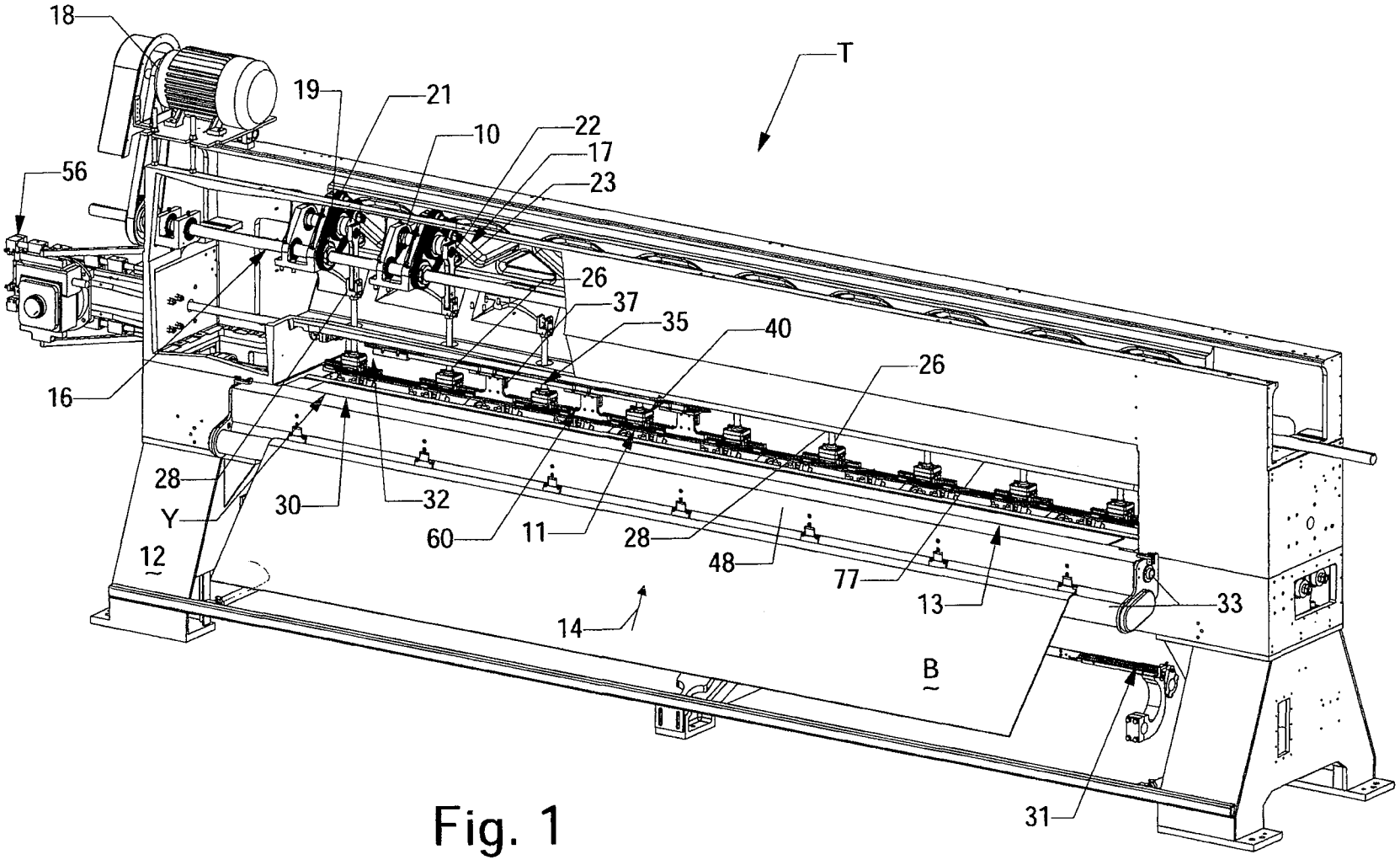
FIG. 1 is a perspective illustration of an example tufting machine, with parts broken away, incorporating the tufting machine drive system according to one embodiment of the present invention.

It will be understood that the drawings accompanying the present disclosure, which are included to provide a further understanding of the present disclosure, are incorporated in and constitute a part of this specification, illustrate various aspects, features, advantages and benefits of the present disclosure and invention, and together with the following detailed description, serve to explain the principles of the present invention. In addition, those skilled in the art will understand that in practice, various features of the drawings discussed herein are not necessarily drawn to scale, and that dimensions of various features and elements shown or illustrated in the drawings and/or discussed in the following detailed description may be expanded, reduced, or moved to an exploded position, in order to more clearly illustrate the principles and embodiments of the present invention as set forth in this disclosure.

DETAILED DESCRIPTION OF THE INVENTION

Referring now to the drawings in which like numerals indicate like parts throughout the several views, the present invention is directed to a drive system for the control of driven operative elements of various types of machines, and in particular the driving of operative elements or components of a tufting machine. In various example embodiments, as shown in FIGS. 1-9C, the drive system 10/100 of the present invention is directed to a system for controlling multi-directional motion of a needle bar 11, or pair of needle bars 11/11', of a tufting machine T (FIG. 1), including reciprocation of the needle bar(s) in a first direction, i.e., a vertical direction, and further as the needle bar(s) is moved in at least one additional or secondary direction (i.e., a lateral or shifting direction) that is different from the first direction of movement of the needle bar. The drive system is designed to provide enhanced rigidity and stability to the needle bar as the needle bar is reciprocated/moved in multiple, different directions for forming a patterned tufted article in a backing material B passing therebeneath. The drive system enables tighter control and/or accuracy of the motion of the needle bar in its multiple directions of movement, even at increased production speeds, so as to facilitate formation of patterned tufted articles with enhanced dimensional stability, and with the incidents of excessive wear on the elements of the drive system due to such increased operational speeds being minimized.

As illustrated in FIG. 1, in one embodiment, the tufting machine T in which the drive system 10 of the present invention is used, includes a frame 12 defining a tufting area or zone 13 through which a backing material B is fed, as indicated by arrow 14. A main driveshaft 16 will be mounted along an upper portion or head of the frame 12, extending laterally thereacross. In one example embodiment, the driveshaft 16 further can extend through and be engaged by a series of needle stroke drive assemblies 17, arranged in spaced series therealong, and will be driven by one or more drive motors 18, such as a variable speed reversible servomotor or other, similar drive motor. For example, a motor 18 can be mounted to the frame 12 at one end thereof, as shown in FIG. 1, and/or another motor can be mounted along the opposite end of the frame with the motor(s) being directly coupled or linked to the main drive shaft 16, or otherwise connected or linked thereto such as by a drive belt or chain.

As also indicated in FIG. 1, each of the needle stroke drives 17 further can include a gear 19 mounted along and driven by the driveshaft 16, and which is engaged by a belt 21 that drives one or more gears and/or a stroke cam 22. A linkage 23 is connected to the stroke cam 22 so as to be driven in a vertically reciprocating manner as the main driveshaft is rotated by operation of its drive motor. Each linkage 23 of each needle stroke drive 17 further generally can be connected to a push rod 26, at an upper, first or distal end 27 thereof. As further indicated in FIGS. 1 and 2, each of the push rods will be linked to the needle bar 11, with each push rod 26 being received and/or extensible through a bushing or guide, such as indicated at 28, for guiding the push rods along their vertically stroked, reciprocal movement, for driving the needle bars in their first direction of movement.

Figure 2:
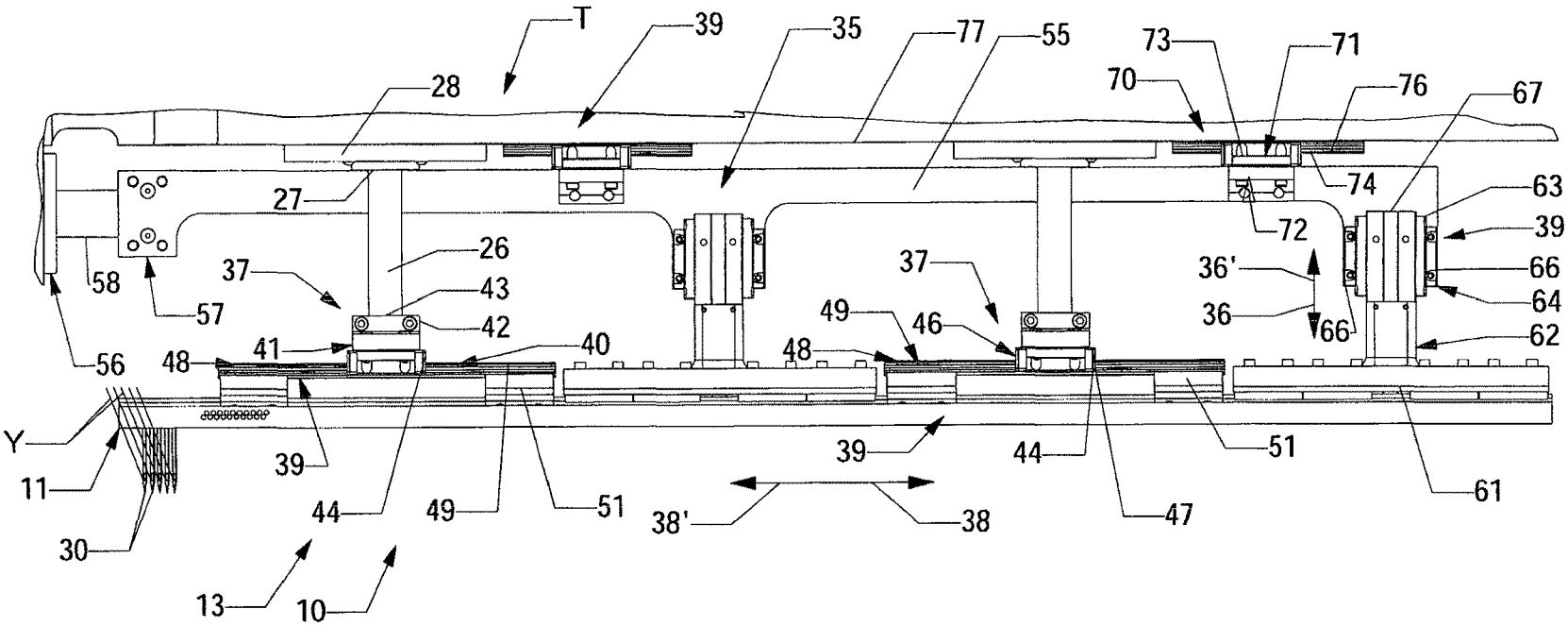
FIG. 2 is a side elevational view of one embodiment of a tufting machine drive system according to the principles of the present invention.

As further indicated in FIGS. 1 and 2, the needle bar 11 will be provided with a series of spaced needles 30. The needles 30 typically will be arranged at positions or locations spaced along the length of the needle bar 11, extending across the tufting area 13, and with the spacing of the needles typically being arranged according to a desired spacing or gauge, such as 1/8, 1/10, 1/16, 5/32, or other gauges or spacings. Only a portion of the needles are shown in FIGS. 1 and 2 for clarity. In addition, those skilled in the art will understand that while a single needle bar is shown in the figures, the drive system 10 according to the principles of the present invention can be used for controlling the differing directional movements of more than one needle bar, i.e., a pair of needle bars, and that the needles mounted therealong can be arranged at varying spacings and/or further can be staggered with respect to one another along a single needle or along more than one needle bar.

As also illustrated in FIG. 1, the needles will carry a series of yarns Y into the backing material B, which typically will be fed through the tufting machine by a series of backing feed rolls 33, whereupon a series of gauge elements 31 will engage corresponding ones of the needles as the needles penetrate the backing material to form tufts 32 of yarns in the backing material B. The gauge elements 31 are generally schematically illustrated in FIG. 1, and can include loop pile loopers, cut pile hooks, level cut loop loopers, cut/loop clips, knives and/or a variety of other types of gauge parts, as will be understood by those skilled in the art, as well as various combinations thereof.

As illustrated in FIGS. 1-7, the drive system 10 according to the principles of the present invention can comprise multiple drive components or portions for controlling the multiple different directional movements of the needle bar 11. For example, the drive system 10 can include a first directional drive component 35 (FIG. 2) for driving the needle bar in a first direction, i.e. controlling the vertical reciprocation of the needle bar in the direction of arrows 36/36' by the operation of the push rods of the tufting machine, and a second directional drive component 37 for driving the needle bar in a second direction, i.e., controlling the lateral or transverse shifting or sliding movement of the needle bar 11 with respect to the path of movement 14 of the backing material B through the tufting zone as indicated by arrows 38/38' in FIG. 2.

Each of the first and second directional drive components 35 and 37 of the drive system 10 further can be supported from the tufting machine and can be coupled to the needle bar by linear motion bearing guide assemblies 39. Such linear motion bearing guide assemblies 39 each can include a recirculating linear bearing mechanism having a set or plurality of bearings 39A (FIGS. 3A-3C) arranged in series along a guide or linear motion bracket, typically along both sides thereof. For example, the linear motion bearing assemblies typically can include a series of ball bearings that can be connected at a desired spacing such as by an elongated chain, cord or other connector, or can be arranged in substantially edge-to-edge contact within a cage received with their guide. Other types of bearings, such as roller bearings or other linear bearings also can be used depending on the components being driven and/or the rates at which such elements are driven. The linear bearing guide assemblies provide increased areas of contact during the movement of the operative elements of the needle bar drive system, i.e., providing a greater number of contact points between the operative, driven elements as they are moved with respect to one another. The linear motion bearings thus can help provide greater control of the movement of such elements while also reducing friction and thus the wearing of the drive system components so as to increase their operational life. Other types of linear bearing or rolling element assemblies, including non-reciprocating linear bearing assemblies, etc., for controlling the movement(s) of the needle bar in desired direction also can be used.

Figure 3A:
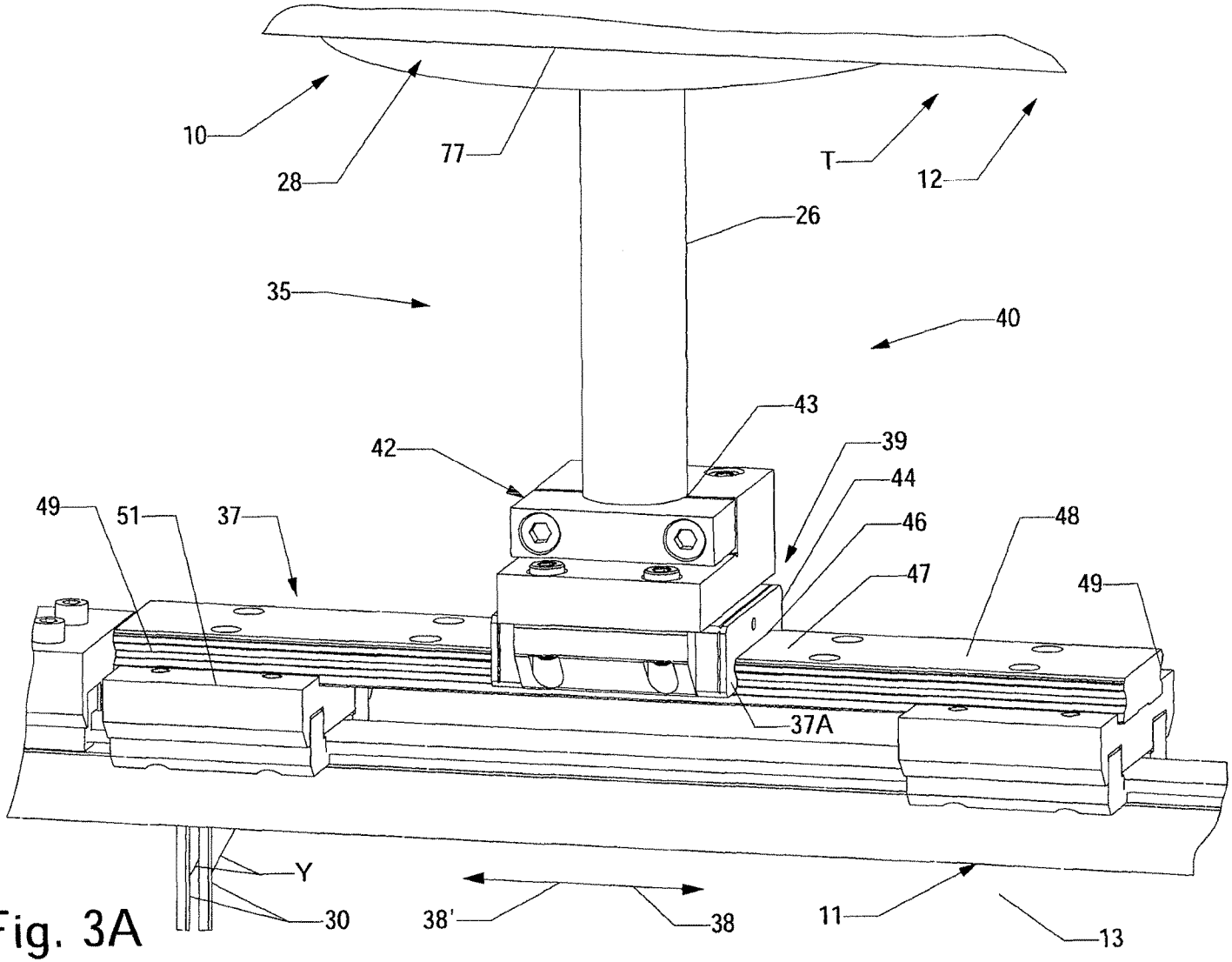
FIG. 3A is a perspective illustration of one embodiment of the connection between a push rod and support bracket of the first directional drive component of the drive system of FIGS. 1 and 2.
Figure 3B:
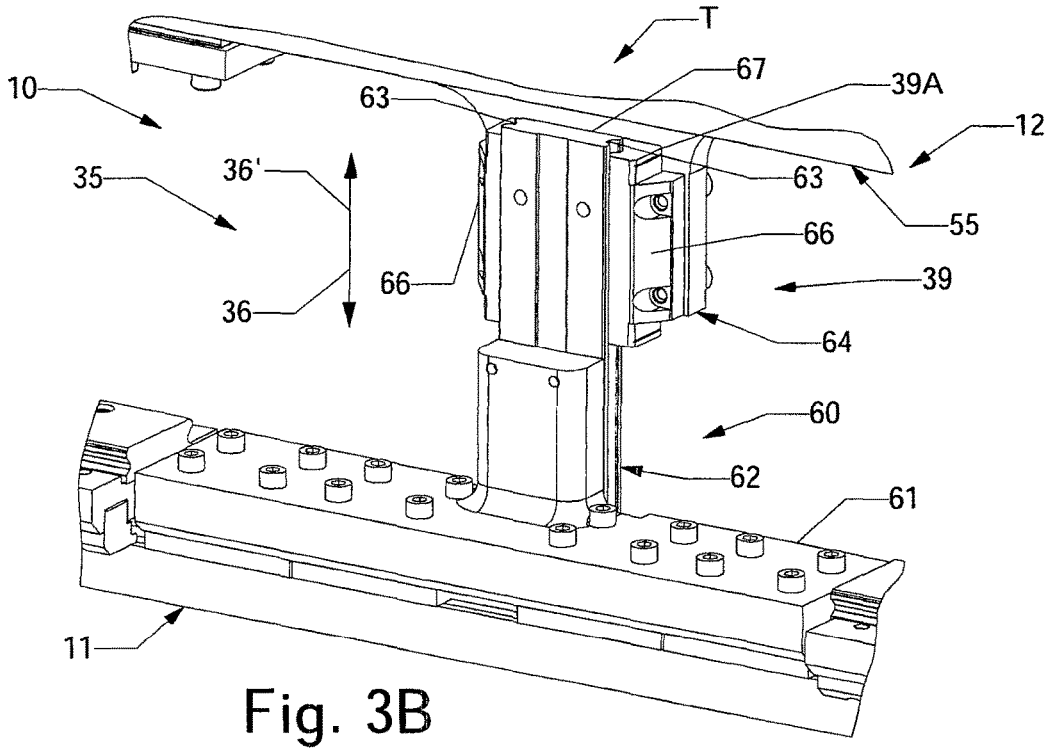
FIG. 3B is a perspective illustration showing the linear bearing guide connection between a shift control rod and a needle bar shift support arm for the second directional drive component of the drive system of FIG. 2.
Figure 3C:
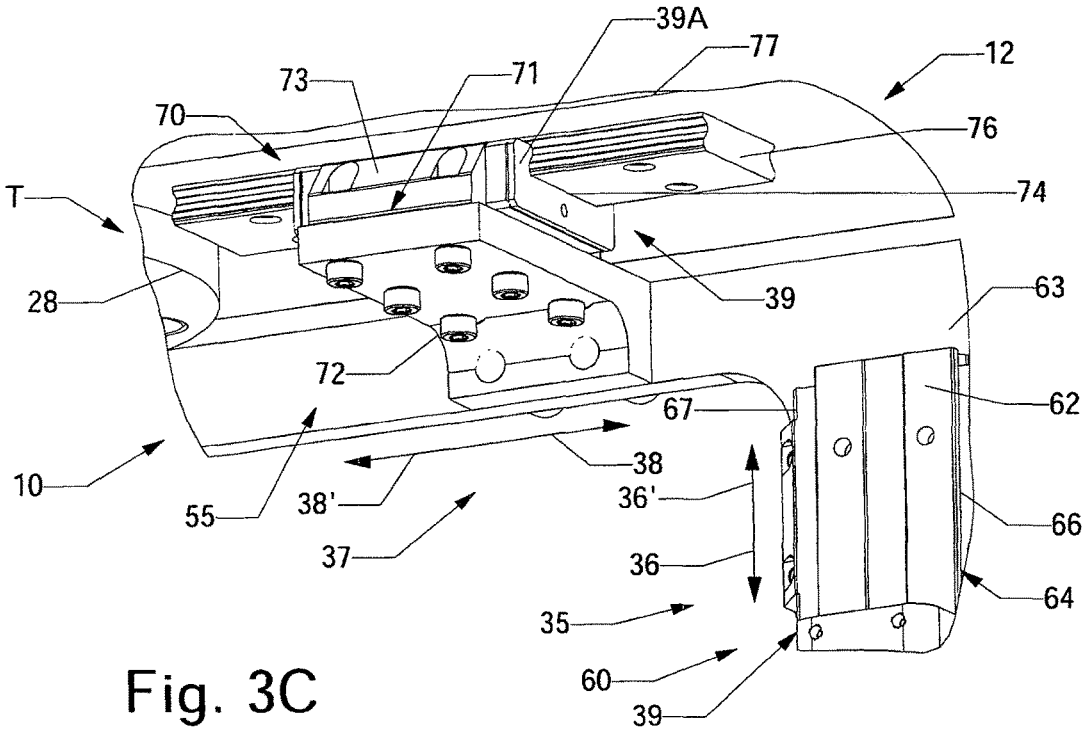
FIG. 3C is a perspective illustration showing one of the shift control support brackets engaging a linear guide track mounted to the frame of the tufting machine in accordance with the drive system shown in FIGS. 1 and 2.

In one embodiment of the drive system 10 illustrated in FIGS. 2-3C, the first directional drive component 35 (i.e., the vertical reciprocating drive component) of the drive system 10 generally will include a series of push rod connector assemblies 40. Each of the push rod connector assemblies 40 will include a support foot or needle bar support bracket 41.

As shown in FIGS. 2 and 3A, the needle bar support brackets or feet 41 can have an upper body portion 42 that can be formed in multiple sections, or can have a construction similar to a conventional support foot, and in which a second, lower or proximal end 43 of a push rod 26 is received in clamping engagement therein, such as by engagement between body sections 42A-42B, secured together by fasteners 42C as indicated in FIG. 3A. The upper body portion 42 of each support foot 41 further will be mounted to a linear motion bearing bracket 44, which can have a substantially U- or C-shaped construction with downwardly projecting guide arms or side sections 46. A channel or passage 47 is defined within the linear motion bearing bracket 44 between the projecting arms 46, which, in one embodiment, can include one or more linear bearing cages having a series of bearings 39A contained therein, and which generally can be arranged on one or more sides of this channel 47. A guide track 48 having guide channels 49 formed along the sides thereof will be received within the channel 47, with the guide channels 49 of the track 48 accordingly being engaged at multiple points therealong by the linear motion bearings of the linear motion bearing bracket 44 so as to be slidable in the direction of arrows 38 and 38' as indicated in FIGS. 2 and 3A. The guide track 48 further can be mounted to a pair of clamp members or brackets 51, here shown mounted at the opposite ends of the guide track so as to couple or connect the needle bar to the guide tracks, and thus to the needle support brackets and push rods. These brackets or clamp members 51 engage and support the needle bar as the needle bar is shifted or moved in the direction of arrows 38/38' by the sliding movement of the guide tracks along the linear motion bearing brackets 44, while at the same time carrying the needle bar along its vertically reciprocatable movement (shown by arrows 36/36' in FIG. 2) with the operation of the push rods 26.

In the embodiment illustrated in FIGS. 1-2 and 3B, the second directional drive component 37 of the drive system 10 can include a drive rod or shaft 55 mounted below or along an under head portion of the tufting machine frame 12, and typically can be mounted along one side (i.e., an upstream or downstream side) of the tufting zone so as to be spaced behind or in front of the push rods 26 to avoid interference therewith. The driveshaft 55 will be connected to a shift mechanism 56 (FIG. 1), typically including a bracket or other connector 57 that connects one end of the drive rod 55 to a distal end of a driveshaft 58 of the shift mechanism 56, as indicated in FIG. 2.

The shift mechanism 56 can include a variety of needle bar shifters, for example, including a SmartStep™ shift mechanism such as produced by Card-Monroe Corp. and as disclosed in U.S. Pat. No. 5,979,344, the disclosure of which is incorporated herein by reference. Other, alternative shift mechanisms, including various servo-driven shifters, mechanical cams and other shift mechanisms as will be understood by those skilled in the art, also can be used.

The drive rod 55 of the second directional drive component 37 will be linked to the needle bar 11 by a series of connecting arm assemblies 60, as shown in FIGS. 2 and 3B. Each of the connecting arm assemblies generally can include a base or bottom portion 61 that is attached to a portion of the needle bar, such as by a series of fasteners, and an upwardly projecting guide arm 62, which can be integrally formed with or mounted to the base 61. The guide arm 62 can have a series of guide tracks or channels 63 formed along one or both sides thereof, and will be received within a linear motion bearing bracket 64, which linear motion bearing bracket can have a similar construction as discussed above, including a pair of arms 66 defining a guide channel 67 therebetween, and with one or more bearing assemblies, which can include a series of s or bearings mounted within a cage or guide, located therealong. The track 63 of each guide arm 62 will be engaged by the bearing assemblies of the linear motion bearing bracket 64 to facilitate and control the movement of the guide arm therethrough.

The needle bar thus will be securely connected to the drive rod 55 so as to translate the lateral shifting movement from the shift mechanism to the needle bar in a controlled manner, while at the same time enabling the needle bar to be reciprocated vertically with the guide arm 62 of each connecting arm assembly 60 being able to freely move in a vertical direction while maintaining a substantially rigid connection between the needle bar and drive rod 55. The linear motion bearing brackets 64 of each of the connecting arm assemblies 60 thus facilitate such vertical movement, while at the same time maintaining dimensional stability and rigidity of its connection to the needle bar as the needle bar is shifted laterally and helping to reduce or minimize vibrational movement of the needle bar during operation of the tufting machine at increased machine speeds.

In addition, as indicated in FIGS. 2 and 3C, the drive rod 55 of the second directional drive component 37 of the drive system 10 further will be connected to a lower or under head portion 77 of the tufting machine frame 12 by a series of shift rod support assemblies 70. Each shift rod support assembly can include a linear motion bearing bracket 71 mounted to a flange or similar support 72 that attaches to the drive rod 55, as shown in FIG. 3C. The linear motion bearing bracket 71 of each shift rod support assembly 70 can include a series of upwardly projecting, spaced arms 73 defining a guide channel 74 therebetween and which receives a guide track 76 mounted to the under head portion 77 of the tufting machine frame 12. The guide track 76 generally will be engaged by one or more bearing assemblies mounted along one or both of the arms 73 of the linear motion bearing bracket 71 so as to enable sliding movement of the drive rod 55 of the second directional drive component of the drive system 10, while at the same time, the increased areas of contact between the tufting machine frame 12 and drive rod 55 enabled by the shift rod support assemblies 70 helps provide additional support and rigidity for the drive rod 55 during shifting to substantially avoid or prevent undue or undesired movement in directions other than the direction of its linear shifting motion.

FIGS. 4A-7B illustrate an additional embodiment 100 of the drive system according to the principles of the present invention, which incorporates an improved needle bar support connection for connecting the push rods to the needle bar, as well as a different shifter connection between the shift mechanism and needle bar likewise designed to provide further increased rigidity and precision in the connection and thus the lateral shifting movement of the needle bar 11. It also will be understood by those skilled in the art that while the present embodiment is illustrated for use with a single needle bar, multiple needle bars also can be controlled by the drive system 100 according to the present embodiment of the invention.

As generally illustrated in FIGS. 4A-7B, the drive system 100 will include first and second directional drive components 101 and 102. The first drive component 101 generally will control the vertical reciprocation of the needle bar 11 and will include a series of needle bar support assemblies 103, each of which receives the proximal end of a push rod 26 therein. In one embodiment, as illustrated in FIG. 6A, each needle bar support assembly 103 generally can include a support bracket or foot 104 having an elongated body 106 in which an opening 107 is formed for receiving the proximal end 43 of the push rod 26 therein. A flange 108 generally can be mounted within the opening 107 for receiving the proximal end in an engaged, secured arrangement within the support foot 104.

Figure 6A:
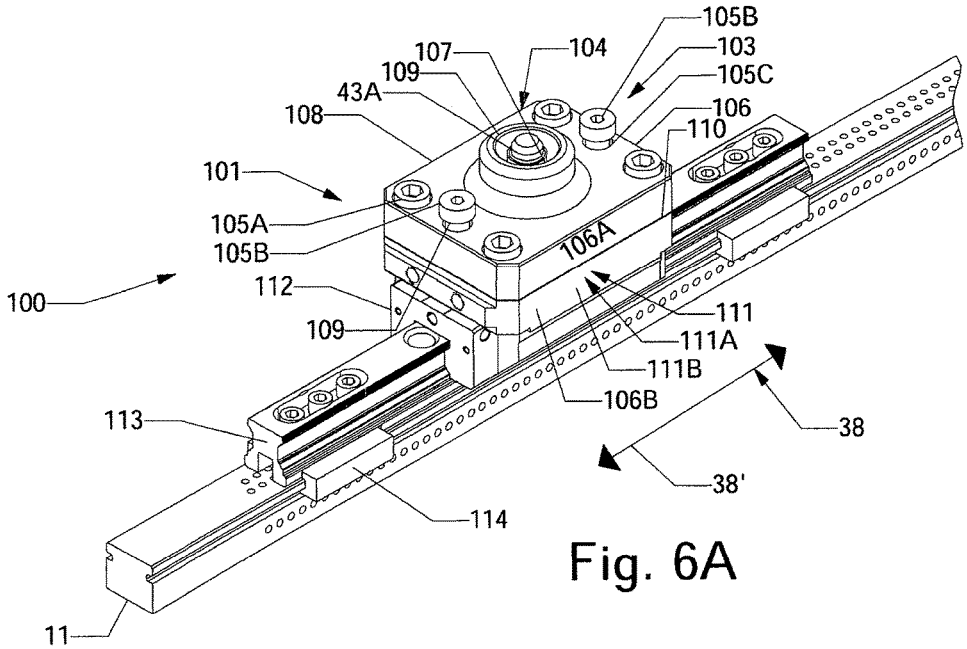
FIGS. 6A and 6B are perspective illustrations of the needle bar support brackets for connecting the push rods of the tufting machine to the needle bar.
Figure 6B:
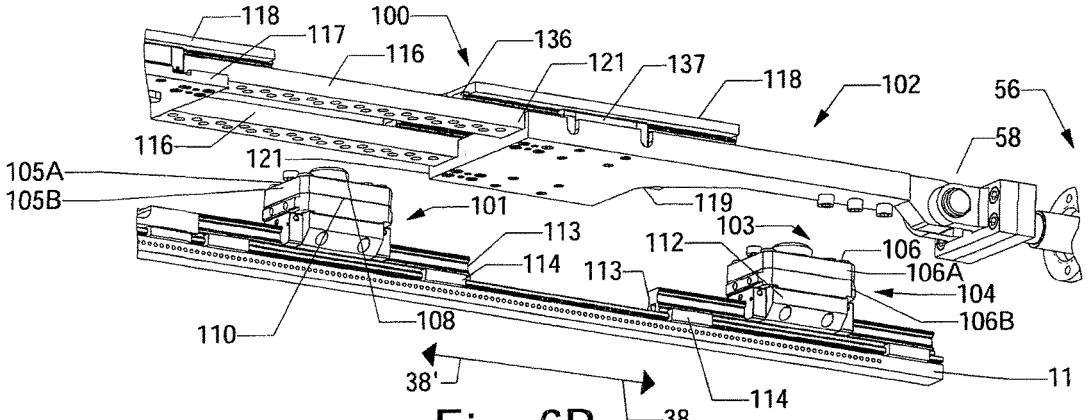
Figure 6C:
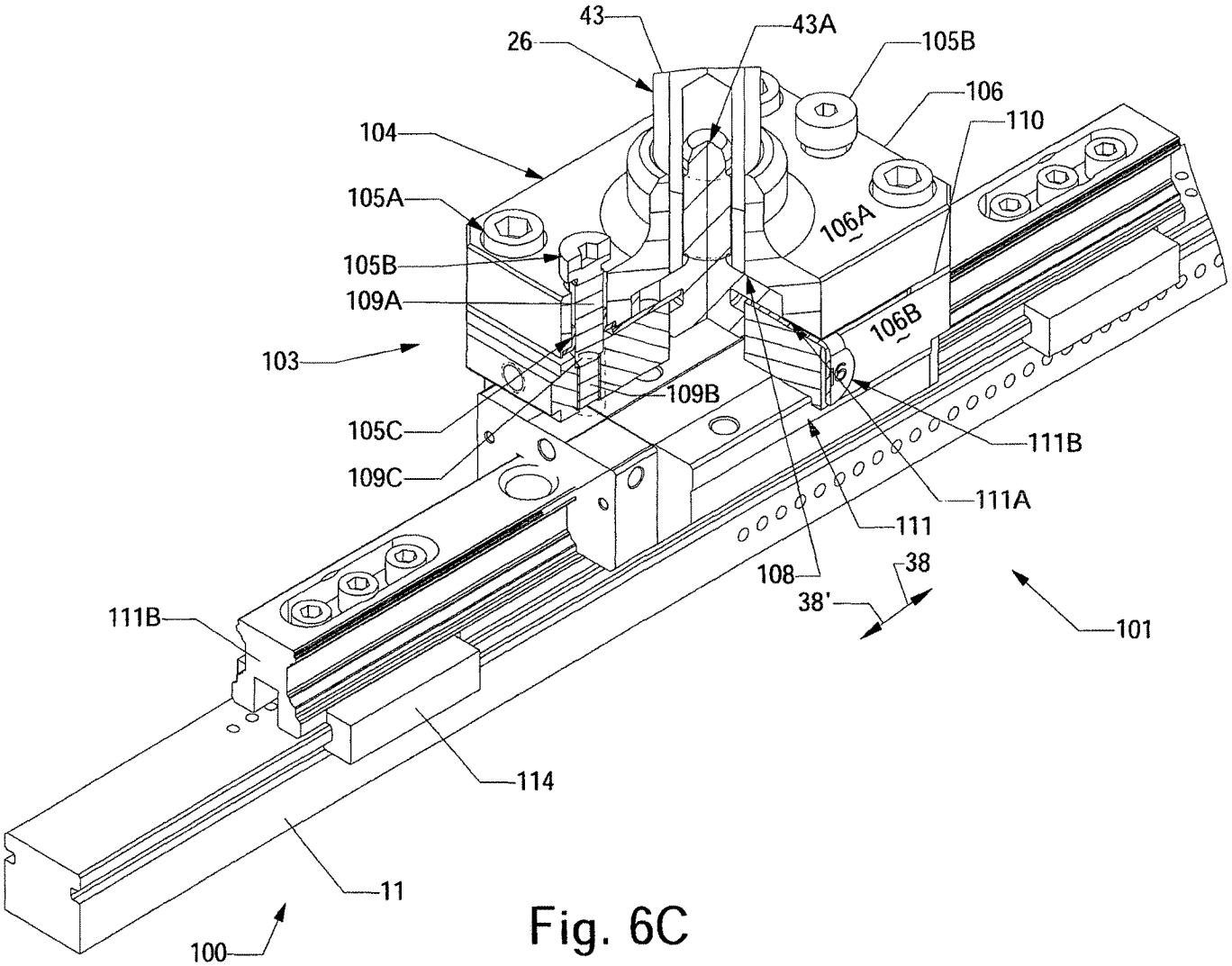
FIG. 6C is a partial cross-sectional view of the needle bar support bracket of FIG. 6A for connecting the push rods to the needle bar.

As illustrated in FIG. 6C, the body 106 of each support foot 104 can include a first or upper section 106A and a second or lower section 106B, one or both of which can be formed from aluminum or other, similar lightweight high strength metal composite or plastic material, to enable in a reduction in weight thereof. The upper and lower sections of the body can be secured together by a series of fasteners, which can include clamping bolts 105A that engage and substantially tightly secure the body sections together, with the flange 108 of the push rod 26 being clamped between the body sections as indicated in FIG. 6C; and a series of shoulder bolts 105B. The clamping bolts 105A, or other, similar fasteners generally can be mounted along or adjacent the peripheral edges of the body 106 of each support foot 104. For example, in one embodiment, the clamping bolts will be located adjacent the corners of the body 106 so as to secure the body sections 106A/106B together at spaced locations about the periphery of the support foot body to help spread or distribute the thrust force created by the push rods 26 as the push rods are moved along their reciprocating stroke or vertical movement for driving the stroke of the needle bar, along or across a wider area of the support foot body. The arrangement of the clamping bolts also can help provide enhanced clamping and stabilization of the push rod support foot, and thus the connection of the push rod to the needle bar, by providing enhanced resistance to axial twisting or torsion of the needle bar and/or support foot due to movement of the backing material as the needles are being reciprocated into and out of the backing material.

As further illustrated in FIG. 6C, a series of shoulder bolts 105B also can be mounted on opposite sides of the push rod 26 as shown in FIG. 6C, including, for example, a pair of shoulder bolts to help guide and/or ensure substantially smooth vertical movement of the shoulder bolts therethrough. Each of the shoulder bolts generally can include an elongated body having upper and lower or first and second portions 109A and 109B, with a shoulder 109C defined therebetween. The shoulder bolts can help secure the body sections together, while further providing a limit or stop that can be used to limit the vertical travel or movement of the upper and lower body sections when the clamp bolts are removed. The shoulder bolts further can help provide spacing or gap 110 defined between the upper and lower sections of the body 106 of each support bracket or foot 104, if needed, for receipt of a series of shims 111 between the body sections for adjustment of the needle stroke or depth of penetration into the backing. It also will be understood that additional shoulder bolts further can be mounted at various locations along the body of each support foot as needed or desired.

Each of the shims 111 generally can have a substantially U-, C- or horseshoe shape or configuration with expanded leg or body portions 111A that are received within the gaps 110 defined between the upper and lower body sections 106A and 106B, and which can provide for increased contact area of the shims therebetween. Each of the shims further can be provided in desired or standard thickness increments or sizes, for example, in thickness of approximately 0.005", although greater or lesser size shims also can be used, with the body portions or sections of each of the shims also generally being readily stackable. The shims can be inserted within the gap 110 defined between the body sections of each of the support feet 104 as needed to incrementally adjust the position of the needle bar with respect to the proximal ends 43 of the push rods 26, in order to adjust the length of the stroke or depth of penetration of the backing without requiring a removal of the entire push rods to substitute greater or lesser length push rods. The rear body section or portion 111B of each of the shims additionally can be formed as a tab and/or can be provided with a specified thickness or other indicator that is readily visible from a side or front portion of the support foot after assembly of the support foot, as indicated in FIG. 6C. Thus, a technician or operator can easily determine what type or thickness shims 111 are being used, as well as the number of shims being used after assembly of the needle bar drive system for operation of the tufting machine by a visual inspection rather than having to disassemble the support foot. The arrangement of the shims between the sections of the body of each support foot 104 further can enable the operator or technician to readily detect whether the shims are installed straight or are misaligned between the body sections.

Still further, the push rods 26 can be provided with a replaceable push rod end or foot, as indicated at 43A in FIG. 6C, to enable further adjustment of the length of each push rod. Such a replaceable push rod end 43A can comprise a sleeve or body section or extension piece received within the proximal end 43 of each pusher rod 26 being mounted thereto such as by fasteners or other connections, and which can be formed in varying lengths or sizes. The replaceable push rod ends can enable further extension of the length of the push rods, and thus the needle bar stroke, as needed, such as where it is impractical or undesirable to use multiple shims for adjustment of the push rod length, without requiring replacement of the entire push rod.

Figure 7A:
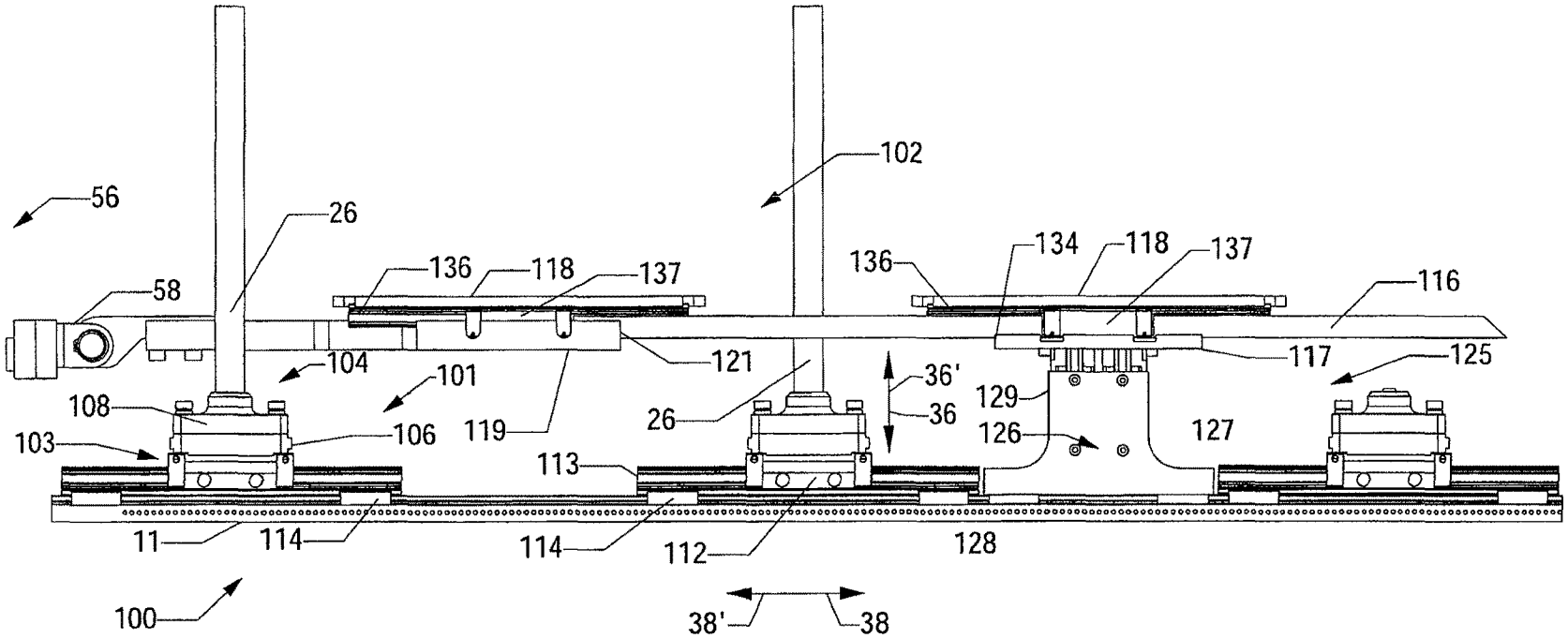
FIG. 7A is a side elevational view of the drive system as shown in FIGS. 4A-5, illustrating the connection of the needle bar to the drive rod(s) of the second directional drive component.
Figure 7B:
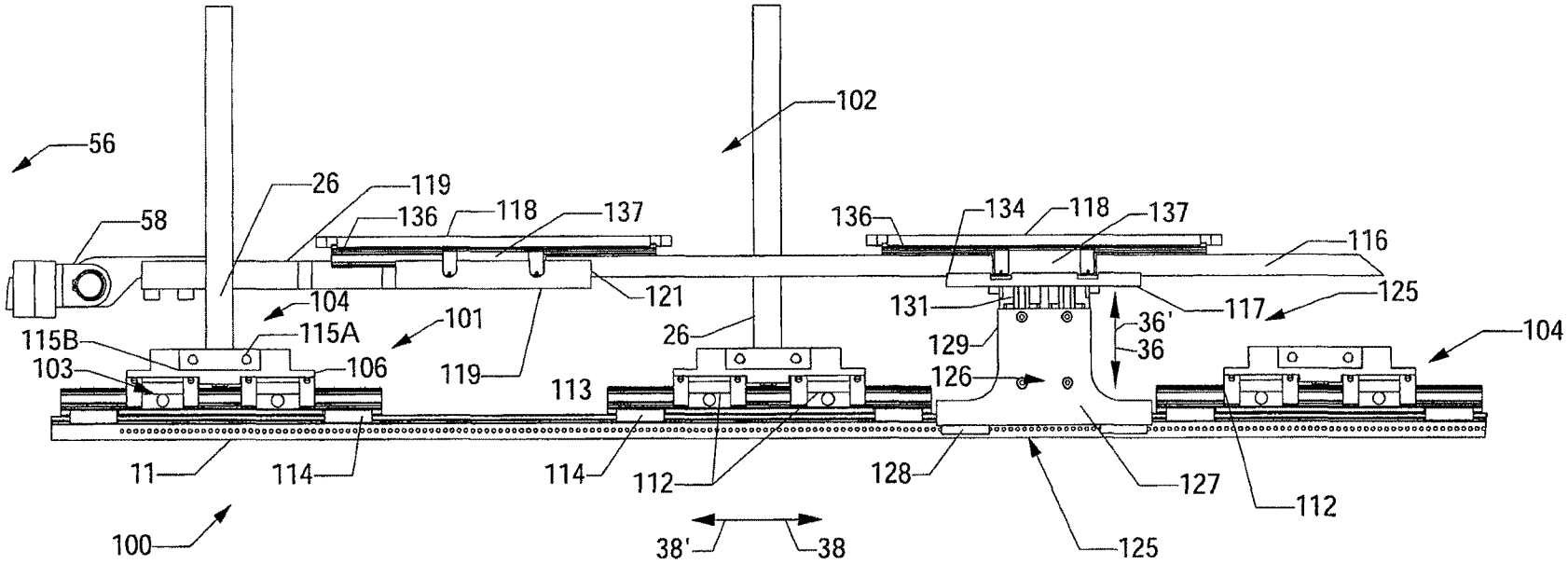
FIG. 7B is a side elevational view of the drive system as shown in FIGS. 4A-5, illustrating an alternative embodiment or configuration of the needle support brackets connecting the needle bar to the drive rod(s) of the second directional drive component.

FIG. 7B illustrates a further alternative configuration or embodiment of the needle bar support brackets or feet 104, in which the body 106 thereof can be formed as a substantially unitary structure with a cut-out portion or recess 115A. The flanges 108 of the support rods 26 can be received within the recess, and can be engaged and secured to the body 106 by a clamp block 115B. The clamp block 115B will fit into the recess, with the flange or end of a push rod engaged between the clamp block and the support foot body. Fasteners can secure the clamp block in its engaged position to secure the push rod to the support foot.

In addition, each support foot 104 generally can include one or more linear motion bearing brackets 112 mounted to the lower section 106B of the body, as illustrated in FIGS. 6A-7A. Alternatively, as shown in FIG. 7B, two or more linear motion bearing brackets 112 can be used, for example, being mounted adjacent the upstream and downstream ends of their support feet. Each of the linear motion bearing brackets 112 can have a similar construction as discussed above, and typically will engage a guide rail or track 113 which can be clamped to the needle bar, such as by fasteners, as indicated in FIGS. 6A and 6C, or alternatively can be mounted to a support plate or plates secured along the needle bar. Thus, the guide track will be supported and stabilized along its length along the needle bar, with the movement of the guide tracks in a transverse direction through the linear motion bearing guide brackets 112 thus providing enhanced support and control during shifting of the needle bar 11 in the direction of arrows 38/38', to enable smoother, substantially more accurate straight-line shifting movements and to reduce or minimize undue wear on the drive system components during such movements, as discussed above. As also indicated in FIGS. 6A-7A, the travel of each support foot 104 along the needle bar during shifting of the needle bar thereunder also can be limited by stops 114 adjacent the ends of the guide rails or tracks 113.

Figure 4A:
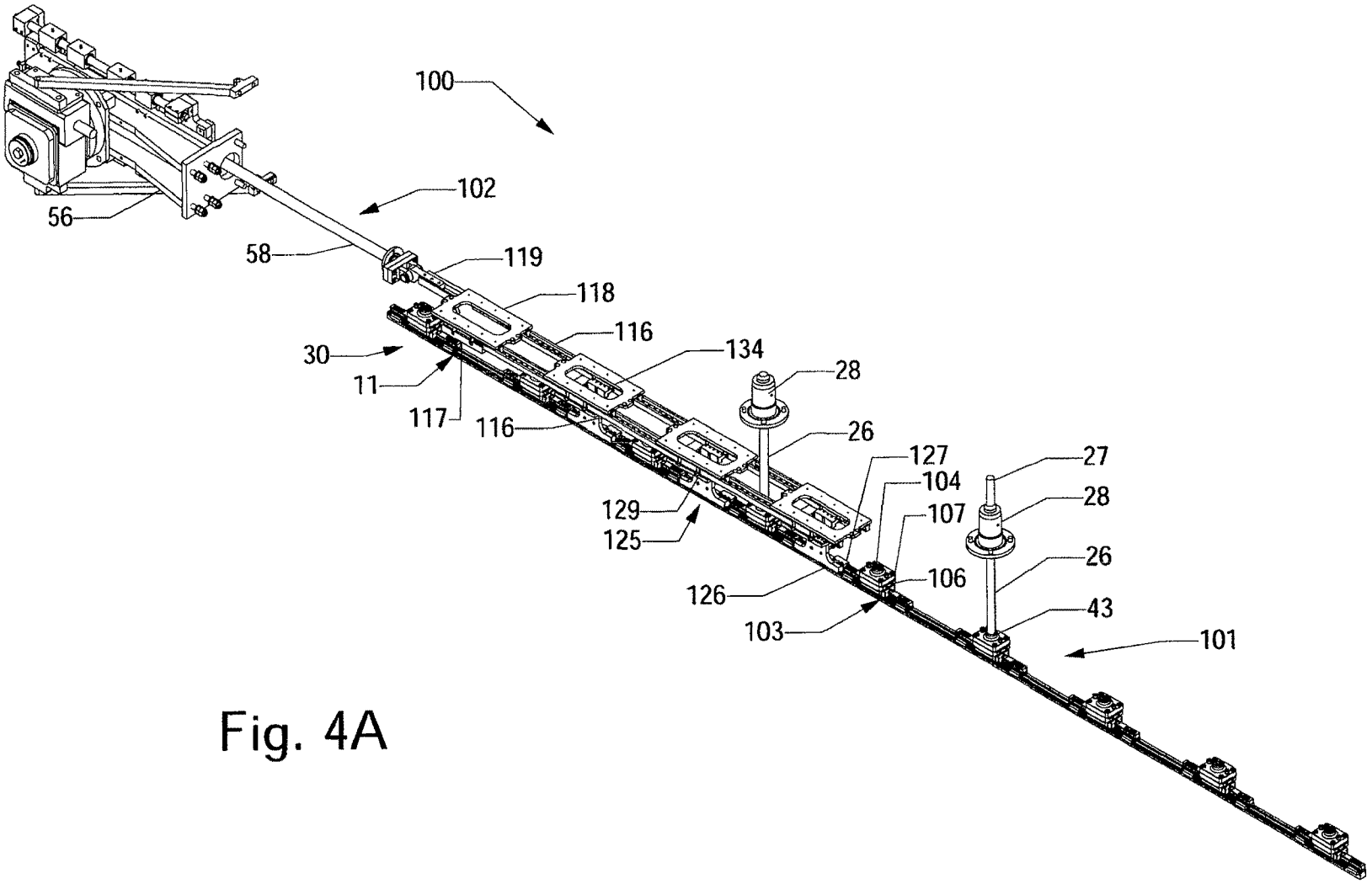
FIGS. 4A-4B are perspective illustrations of another embodiment of the drive system according to the principles of the present invention, illustrating the connection of a shift mechanism to a needle bar.
Figure 4B:
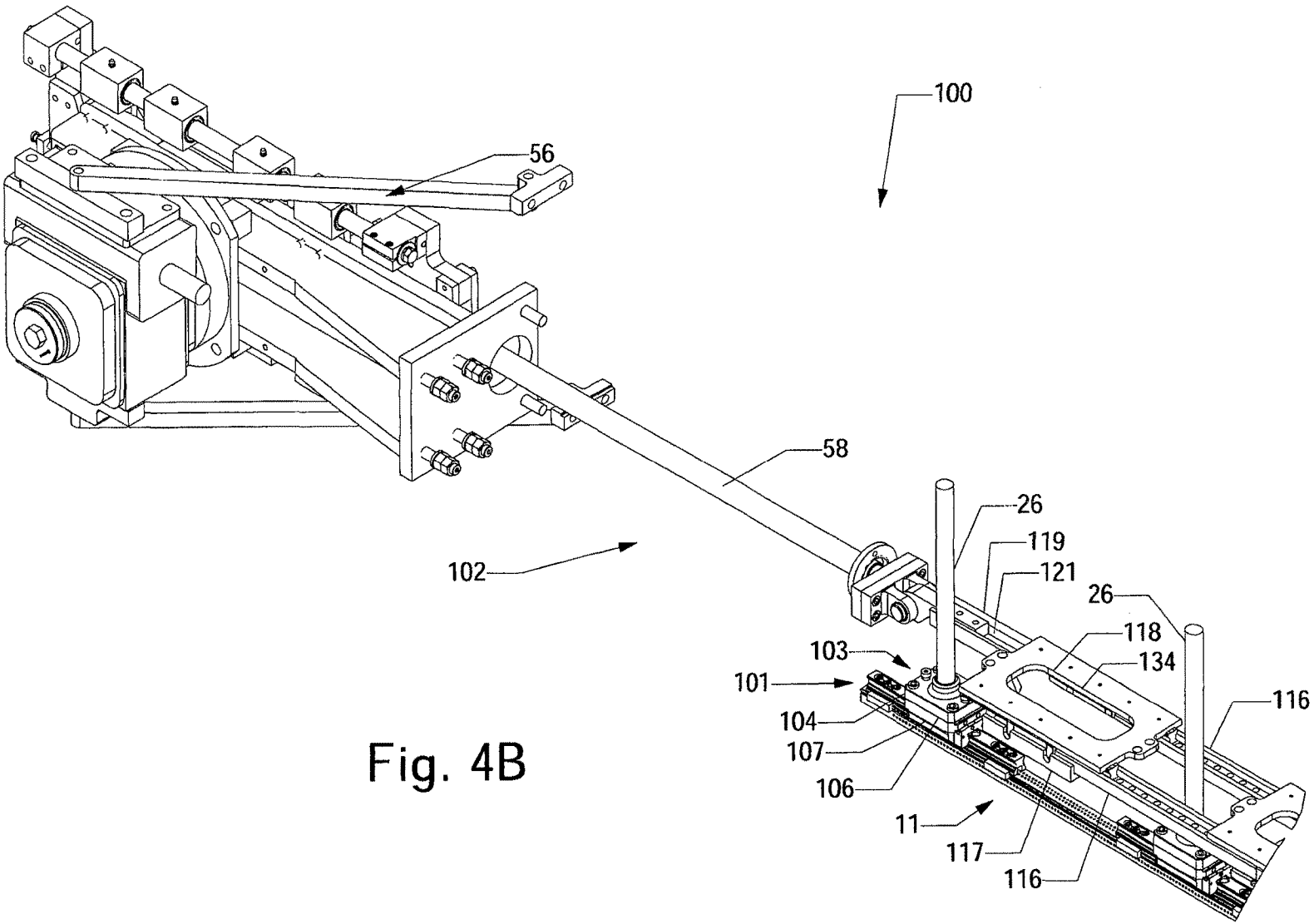
Figure 5:
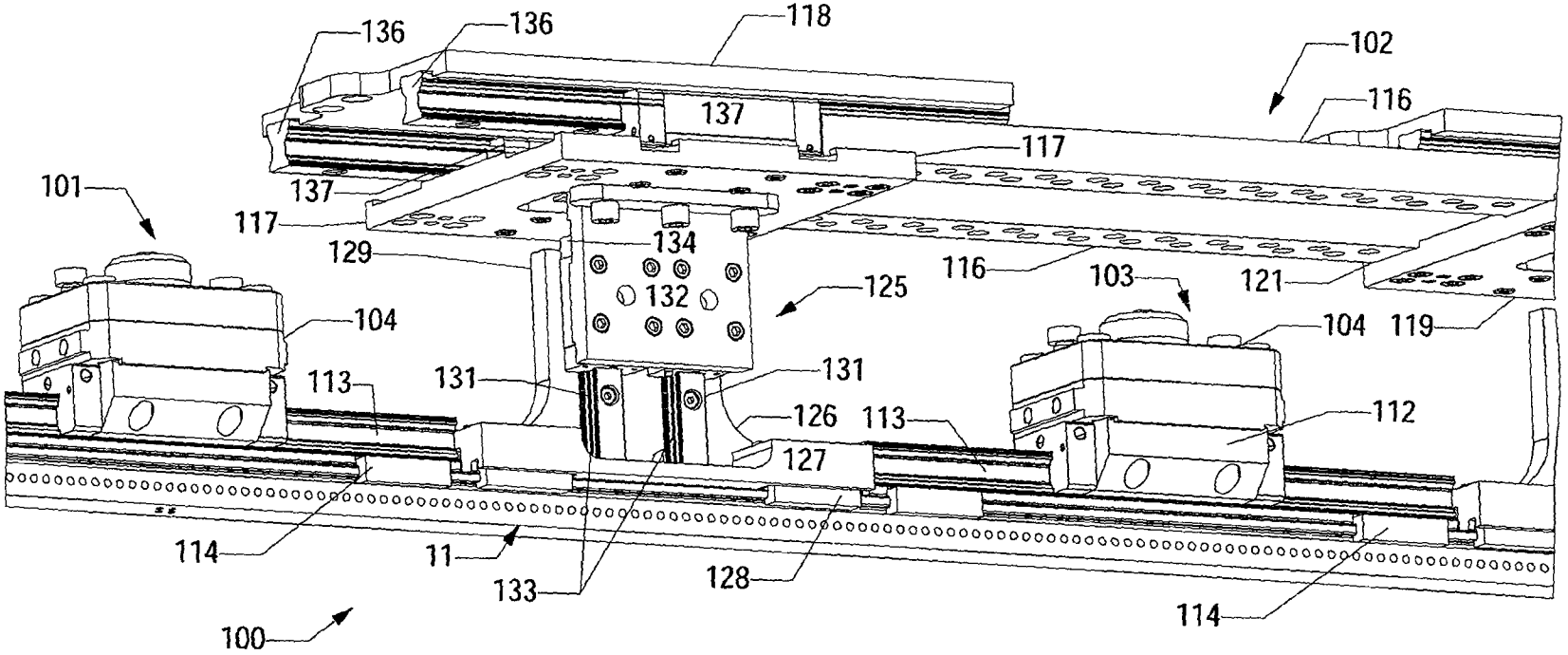
FIG. 5 is a side elevational view of the embodiment of the drive system of FIGS. 4A-4B.

As illustrated in FIGS. 4A-5, 6B and 7A-7B, in the present embodiment 100 of the drive system, the second directional drive component 102, which controls the lateral or transverse movement of the needle bar during a shifting or stepping motion, can include a pair of spaced drive rods or bars 116. The drive rods 116 generally will be connected together at spaced locations therealong by support plates 117 and 118, as indicated in FIGS. 5 and 7A-7B, which will engage the drive rods therebetween and thus rigidly link and support the spaced drive rods 116 for controlling the lateral shifting movement thereof. The drive rods 116 further typically will be spaced by a distance sufficient to enable the push rods 26 connected to the needle bar support assemblies 103 to pass therebetween, as indicated in FIGS. 4A and 4B, while still enabling shifting movement of the needle bar without engaging or otherwise interfering with the reciprocating operation of the pusher rods.

As indicated in FIGS. 4A-5, the driveshaft 58 of the shift mechanism 56 generally can be pivotally connected to a first connecting plate 119 at one end thereof, and with the end of at least one of the drive rods 116 engaging the connecting plate 119 such as by the connecting plate being received within a channel 121 of one of the drive rods and secured thereto via fasteners, as shown in FIG. 4B. As a result, the drive rods 116 are engaged and stably held/connected to the drive shaft 58 of the shift mechanism 56 in a manner sufficient to retard undue movement of the drive rods in directions other than their linear direction of movement in response to the shifting motion imparted by the shift mechanism of the tufting machine.

A series of connecting arm assemblies 125 (FIGS. 4A, 5 and 7A) also will be mounted at spaced locations along the length of the needle bar and will connect the needle bar 11 to the drive rods 116 of the second directional drive component 102. In one embodiment, each of the connecting arm assemblies 125 generally can include a substantially T-shaped body 126 having a base 127 (FIGS. 5 and 7A-7B) that can be mounted to or can engage the needle bar in clamped engagement therewith, as indicated at 128, and an upstanding or upwardly projecting section 129. This upstanding section 129 can include one or more guide tracks 131 mounted thereto and which extends along a desired portion of the length of the upstanding section. The guide tracks 131 can be received within a linear motion bearing guide or bracket 132, having a series of linear motion bearing assemblies mounted therein and which will engage guide channels or grooves 133 of the guide tracks to facilitate the linear movement of the guide tracks, and thus the connecting arm assemblies mounted therealong, as the needle bar is reciprocated vertically by operation of the pusher rods.

As shown in FIG. 5, the linear motion bearing bracket or guide 132 of each connecting arm assembly generally will be mounted to a lower support plate 117 of the drive rods 116 of the second directional drive component 102. Accordingly, as the drive rods 116 are moved in their lateral shifting direction, the connecting arm assemblies, and in turn the needle bar, will be carried along their lateral or shifting movement in a direction transverse to the movement of the backing material through the tufting machine. The support plates 117 and 118 further each can include an opening 134 (FIG. 4B) aligned with the connecting arm assemblies 125, which openings will be configured to enable the upper sections 129 of the connecting arm assemblies to pass therethrough as the needle bar is reciprocated vertically. Thus, the bodies of the connecting arm assemblies can be reciprocated vertically in a stabilized, controlled movement, without interference from or otherwise affecting the lateral/transverse shifting of the needle bar by the drive rods 116.

As illustrated in FIGS. 5, 6B and 7A-7B, the upper support plates 118 for the drive rods 116 of the second directional drive component 102 can be mounted directly to the under head portion 77 (FIG. 1) of the tufting machine frame 12 for supporting the drive rods directly from the tufting machine frame. This arrangement also can provide enhanced rigidity and support, as well as protection against increased vibrational forces due to increased machine operating speeds, which further can help improve accuracy of the shifting movement of the needle bar while also providing for increased longevity of the drive system components. The upper support plates can include spaced guide tracks 136 (FIG. 5), which will correspondingly be engaged by linear motion bearing brackets 137 that can be mounted to the lower support plates 117, or which can be mounted directly to the drive rods 116 for guiding the linear shifting motion of the drive rods, and thus the shifting motion of the needle bar.

Figure 8B:
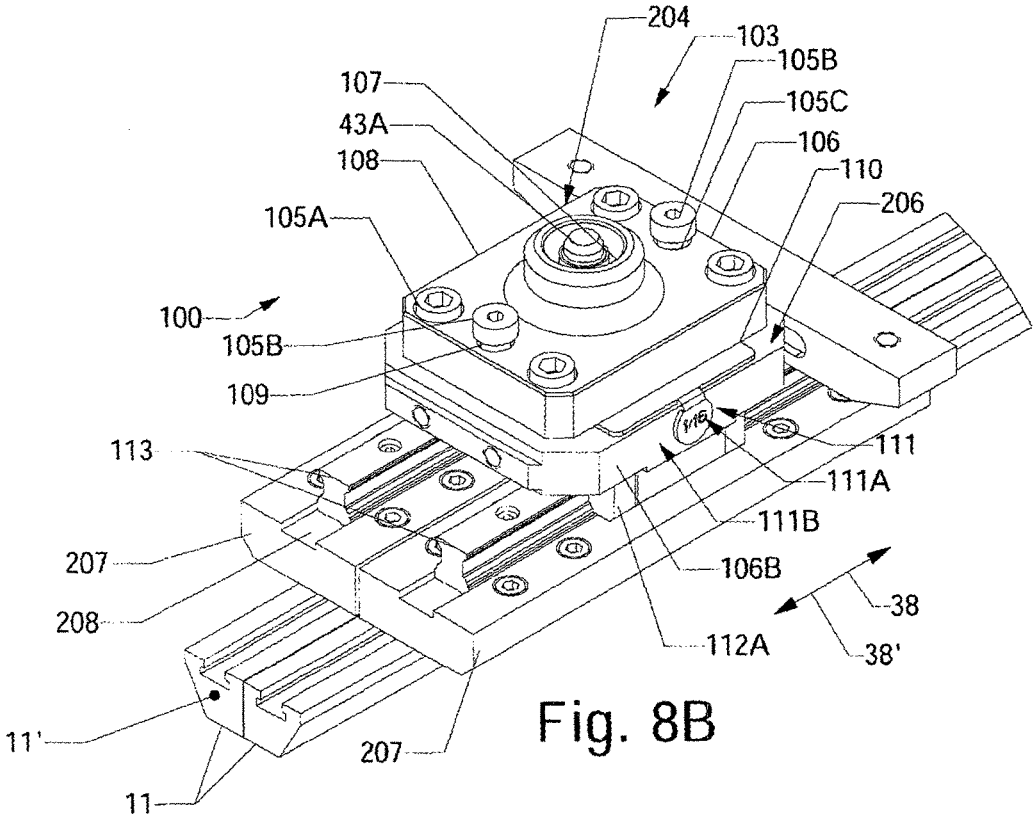
FIG. 8B is a perspective illustration of the needle bar support bracket with linear bearing guides of FIG. 8A for connection of dual shiftable needle bars to the drive system such as illustrated in FIGS. 4A-5.
Figure 8A:
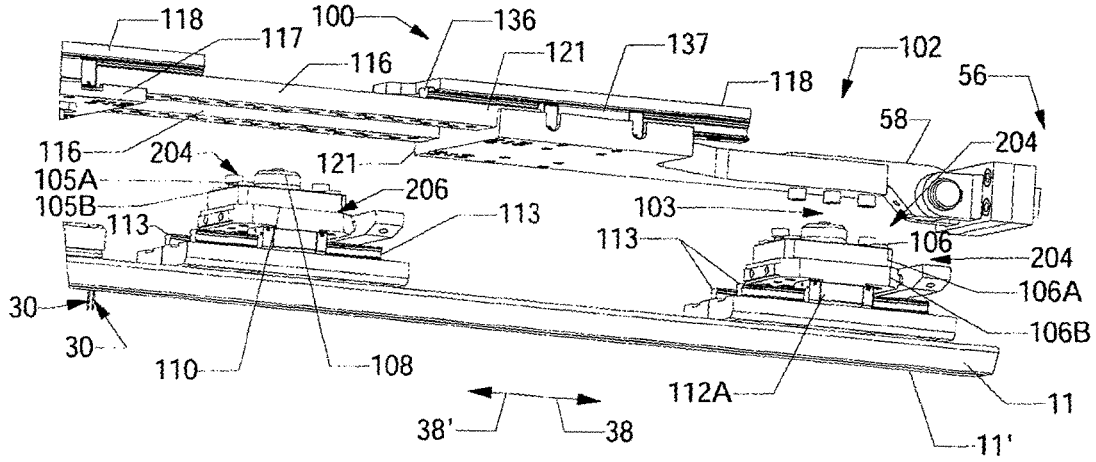
FIG. 8A is a perspective view of the drive system as shown in FIGS. 4A-5 illustrating an additional or alternative embodiment of the needle bar support brackets.
Figure 8C:
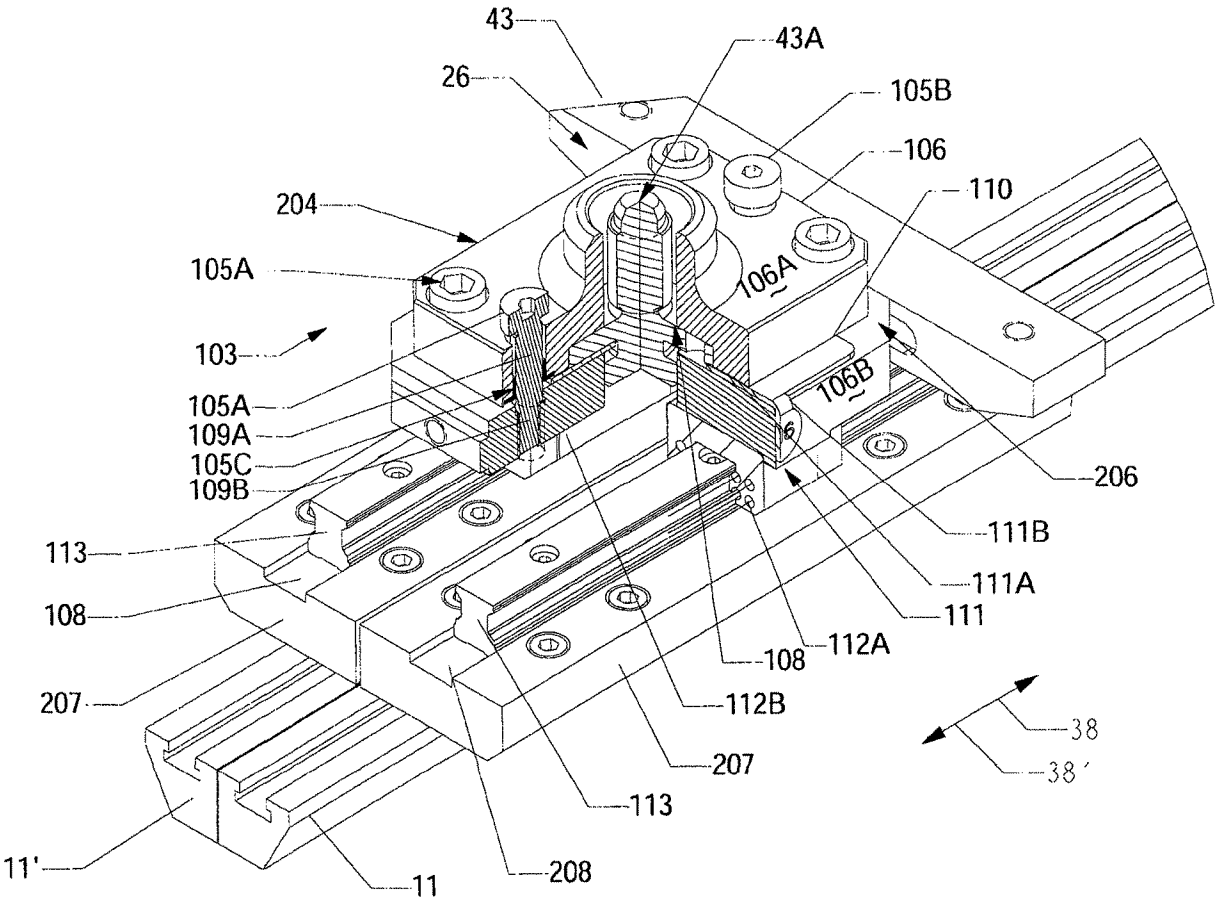
FIG. 8C is a partial cross-sectional view of the needle bar support bracket of FIG. 8B for the connection of dual shiftable needle bars to the tufting machine drive system in accordance with the principles of the present invention.
Figure 9B:
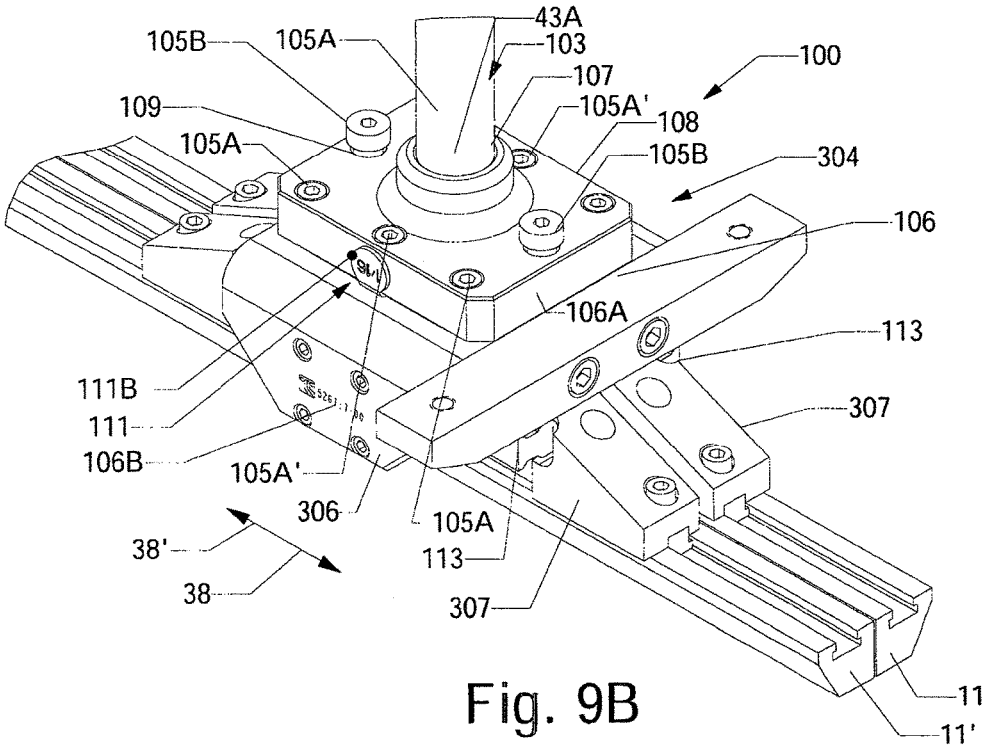
FIG. 9B is a perspective illustration of the needle bar support bracket with linear bearing guides of FIG. 9A for connection of dual shiftable needle bars to the drive system such as illustrated in FIGS. 4A-5.
Figure 9A:
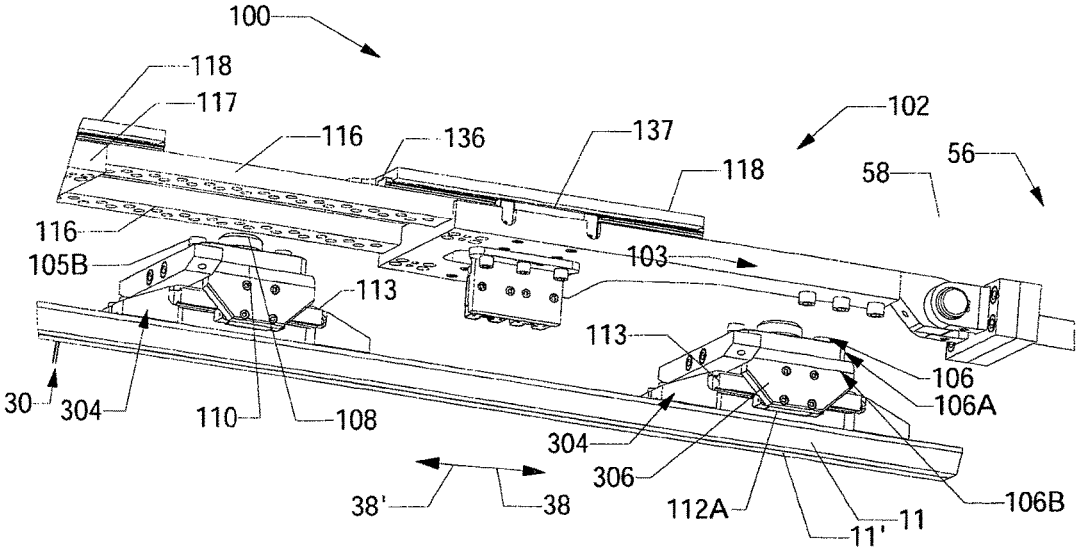
FIG. 9A is a perspective view of the drive system as shown in FIGS. 4A-5, illustrating a further additional or alternative embodiment of the needle bar support brackets.
Figure 9C:
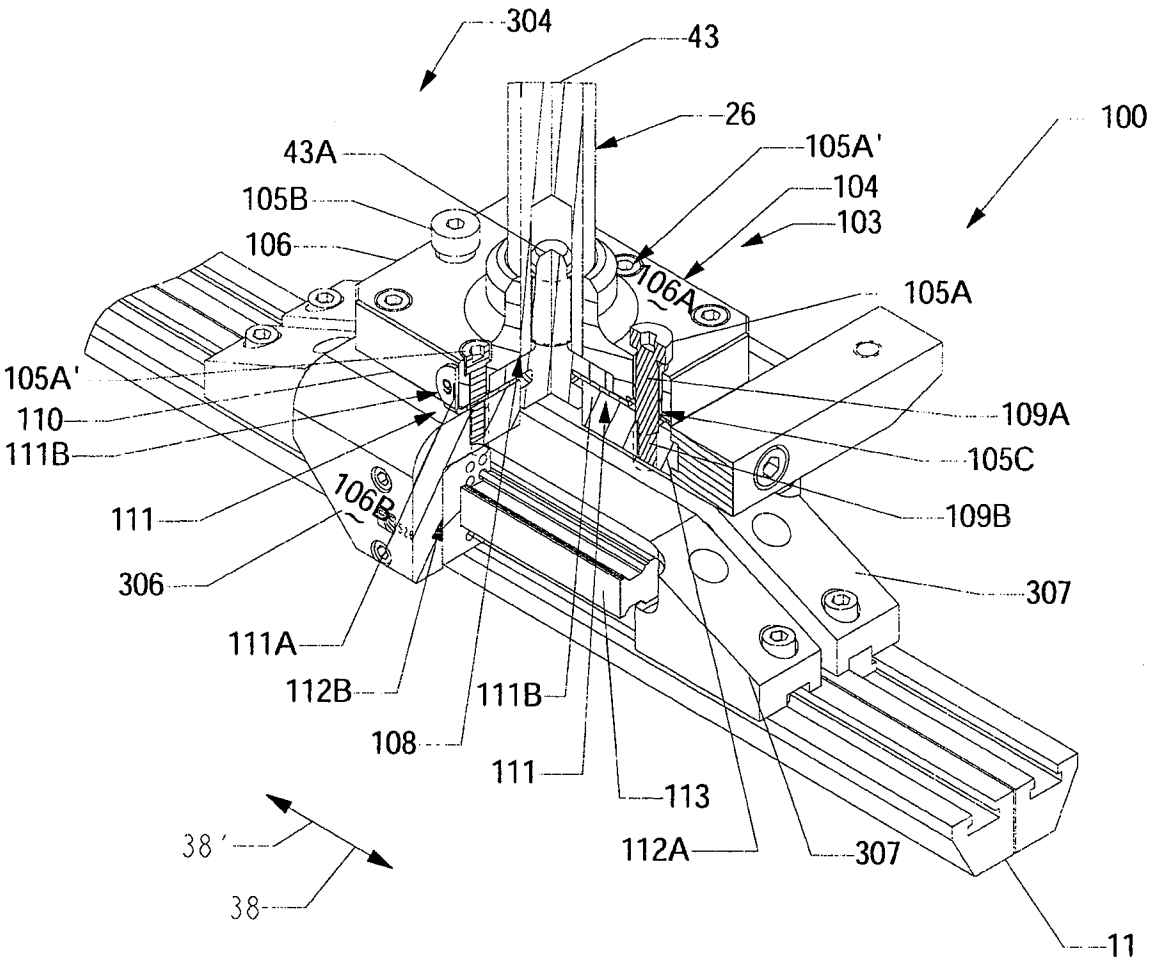
FIG. 9C is a partial cross-sectional view of the needle bar support bracket of FIG. 9B for the connection of dual shiftable needle bars to the tufting machine drive system in accordance with the principles of the present invention.

FIGS. 8A-9C illustrate additional embodiments of the needle support brackets or feet shown at 204 in FIGS. 8A-8C and at 304 in FIGS. 9A-9C, for the needle bar support assemblies for enabling the sliding connection of each of the needle bar support assemblies of the drive system 10/100 of the present disclosure to a pair of sliding needle bars 11. As previously noted, the drive system of the present disclosure can be used in a tufting machine having single or dual shiftable needle bars, such as, for example, an Omnigraph™ tufting machine as manufactured by Card-Monroe Corp., or other, similar types of tufting machines having multiple shifting needle bars for guiding and controlling the movement of the needle bar or bars in multiple directions. The drive system according to the principles of the present invention thus can be variously configured as needed to enable the sliding or transverse shifting movement of the multiple needle bars, including movement in different directions, as the needle bars are reciprocated toward and away from a backing material passing therebeneath, so as to enable enhanced precision and control of the shifting needle bars, and therefore enhanced control of the positioning of the needles by such shifting movements, as the needle bar or bars are reciprocated at speeds as needed to achieve desired enhanced production rates.

In a first embodiment or alternative configuration of the needle support brackets or feet 204, as shown in FIGS. 8A-8C, a needle bar support bracket or foot 204 is shown having a similar construction to the needle support brackets or feet 104 illustrated in FIGS. 6A-6C. For example, the support foot 204 can include a body 106 having first, upper and second, lower body sections 106A and 106B, which are secured together by a series of clamping bolts 105A, shown mounted at the corners thereof, and shoulder bolts 105B mounted on opposite sides of the support foot body. In the present embodiment, the lower body portion or base 106B of the support foot 204 can have expanded size or configuration so as to project outwardly from and/or overlap the sides of the upper body section or top 106A, as indicated a 206 in FIGS. 8B and 8C. The lower body section or base 106B generally can have an expanded width and/or length sufficient to accommodate a pair of spaced guide tracks 113, each of which is received within one of a pair of laterally spaced linear motion bearing brackets 112A and 112B (FIG. 8C). The guide tracks 113 further can be mounted to the needle bars 11/11' by support plates 207. In one embodiment, the support plates 207 can include slots or channels 208 along which the guide tracks 113 are received and can be adjustably positioned, and can be secured directly to the needle bars 11/11' by fasteners and/or by brackets or other connectors.

The linear motion support brackets 112A and 112B generally are shown in FIG. 8C as being mounted to the base or lower portion 106B of the support foot body 106 and will be laterally spaced across the support body base. The spacing of the linear motion bearing brackets 112A and 112B can be selected or set at a distance sufficient to enable free sliding movement of the guide tracks 113, shown in FIGS. 8B and 8C being mounted to their support plates or brackets 207 that are attached to the needle bars, without engagement or interference between the needle bars during their transverse shifting movements. As further illustrated in FIGS. 8B and 8C, the expanded body/base configuration of the support foot 204 further helps enable the operator to quickly and easily visually inspect and detect the placement and number of shims 111 inserted between the upper and lower body sections 106A and 106B. This configuration thus enables an operator to easily determine whether the shims are properly aligned, as well as to determine the number and thickness of the shims installed between the body sections of the support foot 204.

FIGS. 9A-9C illustrate still a further embodiment of a needle bar support bracket or foot 304 of the needle bar support assembly for use in the tufting machine drive system 10/100 according to the principles of the present invention. In the present embodiment, the support foot 304 can include a body 106 having a first, upper portion or top 106A and a second, lower portion or base 106B. The base or lower portion 106B of the support foot body further can have an expanded width or configuration similar to the body of the support foot 204 illustrated in FIGS. 8A-8C, with its base 106B projecting outwardly past the upper portion 106 and including expanded, overlapping side sections or portions 306 that extend outwardly and downwardly along the sides of the body 106, as shown in FIG. 9C.

As additionally illustrated in FIGS. 9B and 9C, the body sections 106A and 106B of the bodies 106 of the support feet 304 generally can be secured together using a series of clamping bolts 105A and shoulder bolts 105B. In the present embodiment, the clamping bolts can be inserted through the body sections 106A/106B adjacent the corner portions thereof so as to help transfer or spread the thrust force being applied by the pusher rods on the support foot, and additionally can include a further series or set of clamping bolts 105A' that are mounted on opposite sides of the push rod and support flange therefor as shown in FIGS. 9B and 9C. The additional clamping bolts 105A' can be provided to further help support and spread the thrust force being applied by the push rods against the support feet 304 along the side portions 306 through which the guide tracks 113 are received. The additional clamping bolts 105A' also can be inserted through the shims 111, as indicated in FIG. 9C, to help secure the shims and maintain, and potentially assist in guiding the shims into a proper alignment between the body sections.

As further indicated in FIGS. 9B and 9C, the needle bars can be mounted to a series of support brackets or plates 307 each of which can have a reduced profile or size that does not substantially overlap the sides of the needle bars, as, for example, the support plates 207 shown in the embodiment of FIGS. 8B and 8C. In the embodiment illustrated in FIGS. 9A-9C, the guide tracks 113 for guiding the transverse sliding movement of the needle bars 11 can be repositioned and/or reoriented so as to extend along the sides of the support plates 307. The guide tracks 113 will be engaged by linear motion bearing brackets 112A/B, as indicated in FIG. 9C, which are mounted along the overlapping side portions 306 of the base or lower portion 106B of the body of each support foot 304. The guide tracks 113 further are mounted to and extend along the sides of the needle bar support plates 307, being received through and engaged by the linear motion bearing brackets 112 mounted along the overlapping or projecting side portions 306 of the support foot 304 in the present embodiment.

The movement of the guide tracks along their linear motion bearing guides 112 guides and controls the transverse shifting or sliding movement of the needle bars 11 in the direction of arrows 38 and 38'. The present arrangement of the guide tracks being reoriented along the sides of the needle bar support plates 307 further can provide a reduced profile while maintaining the needle bars in a substantially closely spaced configuration as they are shifted laterally and moved in a vertically reciprocating manner by the operation of the push rods, which can further help prevent twisting or undue lateral movement of the needle bars during high-speed tufting operations.

The present invention accordingly is designed to provide a drive system for driving various operative elements, including the needle bar or needle bars of a tufting machine to provide enhanced rigidity and support, and accordingly increased control of the motion of the needle bar in its multiple directions of movement including vertical reciprocation as well as lateral or transverse shifting motion of the needle bar to provide for increased accuracy and dimensional stability of tufted articles produced and for prevention of excessive wear of gauge parts, while further enabling increased machine operating speeds.

It also will be understood by those skilled in the art that while various example embodiments of the drive system according to the principles of the present invention have been discussed herein, the constructions of such embodiments can be modified or changed as needed, such as by reversing the mounting of the linear motion bearing brackets and guide tracks to the various operative components being controlled. For example, as opposed to having guide tracks mounted to the under head portion of the tufting machine frame or along support plates mounted thereto, such guide tracks can be mounted to the supports for the drive rod of the second directional drive component, and can be received within linear motion bearing brackets that are mounted directly to the under head portion of the tufting machine and/or support plate. Various other modifications and combinations of the features illustrated in the embodiments discussed above also can be used.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, this disclosure covers various modifications, combinations, alterations, etc., of the above-described embodiments, as well as various other combinations, modifications, and environments, which are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

The invention claimed is:

1. A tufting machine for forming tufted articles, comprising:

backing feed rolls feeding a backing material through the tufting machine;

at least one needle bar having a plurality of needles mounted therealong, each of the needles carrying a yarn for forming tufts of yarns in the backing material as the needles are reciprocated into and out of the backing material;

a first directional drive component including a series of push rods for driving the at least one needle bar in a first direction along its reciprocating motion, and a series of needle bar support brackets coupled to the push rods, the needle bar support brackets including linear motion bearing guides each having a series of linear motion bearings arranged therealong and configured to slidably receive a guide track mounted to the at least one needle bar as the at least one needle bar is moved in a second direction and the at least one needle bar is reciprocated in the first direction; and a second directional drive component including at least one shift mechanism connected to the at least one needle bar by at least one connecting arm assembly, the at least one connecting arm assembly comprising a guide arm mounted to the at least one needle bar and a linear bearing assembly bracket having linear motion bearings therealong and defining a channel through which the guide arm is received during the reciprocating movement of the at least one needle bar in its first direction while the at least one needle bar is moved in its second direction substantially transverse to the first direction by the at least one shift mechanism.

2. The tufting machine of claim 1, wherein the second directional drive component further comprises at least one drive rod coupled to the at least one shift mechanism, and a series of supports mounted to a frame of the tufting machine, each of the supports having a linear bearing assembly extending therealong for slidably supporting the at least one drive rod from the frame of the tufting machine.

3. The tufting machine of claim 2, wherein the at least one connecting arm assembly comprises a series of spaced connecting arm assemblies, each including a body having a base engaging the at least one needle bar, and an upper section including a guide track received within and slidable along a linear motion bearing guide mounted to one of the supports, and wherein the supports define openings through which the guide arms of the connecting arm assemblies pass as the at least one needle bar are moved in the first direction.

4. The tufting machine of claim 1, wherein the at least one needle bar comprises a pair of needle bars and the at least one needle bar shift mechanism comprises a pair of shift mechanisms for shifting the needle bars in their second direction independently of each other.

5. The tufting machine of claim 1, wherein the linear motion bearings of the linear motion bearing guides and the linear bearing arm assembly comprise reciprocating linear bearings.

6. The tufting machine of claim 1, wherein the needle bar support brackets each comprise a body having upper and lower body sections coupled by a series of fasteners, the upper body section having an opening formed in an upper surface through which an end of one of the push rods is received, and wherein at least one shim is received between the upper and lower body sections.

7. The tufting machine of claim 6, wherein the at least one shim comprises a series of stackable shims, visible along at least a portion of the needle support brackets to enable visual detection of the shims between the first and second body sections.

8. The tufting machine of claim 6, wherein the lower body sections of the needle bar support brackets have an expanded configuration so as to project outwardly from the upper body sections.

9. The tufting machine of claim 6, wherein the fasteners comprise:

a series of shoulder bolts received through the first and second body sections and each having a shoulder for limiting vertical movement of the body sections, and clamping bolts extended through the first and second body sections adjacent corners thereof to help distribute a thrust force transmitted by the push rods across the body of each support bracket.

10. A tufting machine for forming tufted articles, comprising:

backing feed rolls feeding a backing material through the tufting machine;

a pair of needle bars each having a plurality of needles, carrying a series of yarns, and wherein the needle bars are moveable in a first direction for moving the needles into and out of the backing, and in a second direction so as to move the needles transversely with respect to the movement of the backing through the machine; and a drive system for guiding movement of the needle bars along the first and second directions, the drive system having a first directional drive component comprising a series of push rods coupled to the pair of needle bars and connected to a main drive for driving the needle bars in a reciprocating motion along their first direction for forming tufts of yarns in the backing material, and a second directional drive component comprising to at least one shift mechanism coupled to each of the needle bars and operable for moving the needle bars in their second direction substantially transverse to their first direction;

wherein the drive system further includes a series of needle bar support brackets coupling the push rods to the needle bars and each comprising a first body section in which a push rod is received, a second body section adjustably coupled to the first section and having one or more linear motion bearing guides mounted therealong and defining a pair of channels with linear motion bearings arranged therealong and through which guide tracks mounted to each of the needle bars are slideably received during movement of the needle bars in their second direction for shifting of the needles across the backing material.

11. The tufting machine of claim 10, further comprising a series of shoulder bolts received through the first and second body sections and each having a shoulder for limiting vertical movement of the body sections.

12. The tufting machine of claim 10 further comprising clamping bolts extended through at least a portion of the first and second body sections adjacent each corner thereof to help distribute a thrust force from the push rods across the body of each support bracket.

13. The tufting machine of claim 12, further comprising a series of additional fasteners located along the needle bar support brackets between corners thereof, the additional fasteners extending through one or more shims received between the body sections.

14. The tufting machine of claim 10, further comprising a series of stackable shims received between the first and second body sections in a position to enable visual detection of the shims between the first and second body sections.

* * * * *